US009174816B2

(12) United States Patent
Saito et al.

(10) Patent No.: US 9,174,816 B2
(45) Date of Patent: Nov. 3, 2015

(54) SHEET ALIGNING AND SHIFTING DEVICE

(71) Applicants: Takehiko Saito, Yamanashi-ken (JP); Satoshi Yamanushi, Yamanashi-ken (JP); Tatsuzo Aoyagi, Yamanashi-ken (JP); Yuichi Ichinose, Yamanshi-ken (JP); Yusuke Saito, Yamanashi-ken (JP)

(72) Inventors: Takehiko Saito, Yamanashi-ken (JP); Satoshi Yamanushi, Yamanashi-ken (JP); Tatsuzo Aoyagi, Yamanashi-ken (JP); Yuichi Ichinose, Yamanshi-ken (JP); Yusuke Saito, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 113 days.

(21) Appl. No.: 14/051,599

(22) Filed: Oct. 11, 2013

(65) Prior Publication Data

US 2014/0103596 A1 Apr. 17, 2014

(30) Foreign Application Priority Data

Oct. 12, 2012 (JP) ..... 2012-227468
Dec. 28, 2012 (JP) ..... 2012-287584
Dec. 28, 2012 (JP) ..... 2012-287585

(51) Int. Cl.

| | |
|---|---|
| ***B65H 37/04*** | (2006.01) |
| ***B65H 9/00*** | (2006.01) |
| ***B65H 39/00*** | (2006.01) |
| ***B65H 31/02*** | (2006.01) |
| ***B65H 31/34*** | (2006.01) |
| ***B65H 33/08*** | (2006.01) |
| ***B65H 39/10*** | (2006.01) |

(52) U.S. Cl.

CPC ..... *B65H 9/002* (2013.01); *B65H 31/02* (2013.01); *B65H 31/34* (2013.01); *B65H 33/08* (2013.01); *B65H 39/00* (2013.01); *B65H 39/10* (2013.01); *B65H 2301/4212* (2013.01); *B65H 2404/152* (2013.01); *B65H 2404/5311* (2013.01); *B65H 2404/693* (2013.01); *B65H 2404/696* (2013.01); *B65H 2405/113* (2013.01); *B65H 2405/114* (2013.01); *B65H 2801/27* (2013.01)

(58) Field of Classification Search

CPC ..... B65H 37/04
USPC ..... 270/58.11, 58.12, 58.16, 58.17
See application file for complete search history.

(56) References Cited

U.S. PATENT DOCUMENTS

| | | | | |
|---|---|---|---|---|
| 4,500,085 | A * | 2/1985 | Rayfield et al. | 271/207 |
| 5,080,342 | A * | 1/1992 | Mori et al. | 270/58.11 |
| 5,120,046 | A * | 6/1992 | Mandel et al. | 271/220 |
| 6,561,504 | B2 * | 5/2003 | Mlejnek et al. | 270/58.12 |
| 6,695,300 | B2 * | 2/2004 | Saito | 270/58.14 |
| 6,910,688 | B2 * | 6/2005 | Saito et al. | 271/220 |
| 6,986,510 | B2 * | 1/2006 | Saito et al. | 271/220 |
| 7,413,180 | B2 * | 8/2008 | Kobayashi | 270/58.12 |

FOREIGN PATENT DOCUMENTS

| | | |
|---|---|---|
| JP | H11-079527 A | 3/1999 |
| JP | 2006-044898 A | 2/2006 |
| JP | 2006-256727 A | 9/2006 |

* cited by examiner

*Primary Examiner* — Patrick MacKey
(74) *Attorney, Agent, or Firm* — Manabu Kanesaka

(57) ABSTRACT

A sheet storage apparatus includes a sheet discharge path having a sheet discharge outlet; a stack tray disposed on a downstream side of the sheet discharge outlet; a support device disposed between the sheet discharge outlet and the stack tray to load at least a part of a sheet; a sheet end regulation device for regulating a position of at least one end edge of the sheet supported by the support device; and an aligning transport device disposed in the support device to carry the sheet toward the sheet end regulation device. The aligning transport device includes a friction transport body and a transport body travel device, and the friction transport body has a rotating member rolling along the top surface of the sheet supported by the support device, and the rotating member rotates in a direction crossing the travel direction.

16 Claims, 21 Drawing Sheets

SHEET ALIGNING AND SHIFTING DEVICE

RELATED APPLICATIONS

The present application is based on, and claims priority from, Japanese Applications No. JP2012-227468 filed Oct. 12, 2012; No. JP2012-287584 filed Dec. 28, 2012; and No. JP2012-287585 filed Dec. 28, 2012, the disclosure of which is hereby incorporated by reference herein in its entirety.

BACKGROUND OF THE INVENTION

1. Field of the Invention

The present invention relates to a sheet storage apparatus that stores a sheet carried out of an image formation apparatus or the like on a stack tray, and more particularly, to improvements in the sheet alignment mechanism in collecting sheets in the shape of a bunch in a predetermined post-processing position.

2. Description of the Related Art

Generally, in this type of apparatus, sheets fed from an image formation apparatus or the like are carried in a sheet discharge path, and are stored on a stack tray disposed on the downstream side of a path sheet discharge outlet. Then, such an apparatus is widely known as an apparatus in which a processing tray (sub-tray) to temporarily mount and support sheets is provided between the sheet discharge outlet and the stack tray, sheets are collated and subjected to post-processing on the tray, and the processed bunch of sheets is carried out to the stack tray.

For example, in Patent Document 1 (Japanese Patent Gazette No. 4500713 (FIG. 1)) is proposed a post-processing apparatus provided with a sheet carry-in path coupled to a sheet discharge outlet of an image formation apparatus, a processing tray disposed on the downstream side of the path sheet discharge outlet, and a stack tray on the downstream side of the processing tray. Then, sheets fed from the image formation apparatus are switchback-transported from the sheet discharge outlet to the processing tray, and collated and collected. The bunch of sheets is subjected to staple binding or jog-offset, and is carried out to the stack tray on the tray downstream side.

Accordingly, in such an apparatus configuration, the sheet carry-in path, processing tray and stack tray are laid in the apparatus housing in this order, and the sheet is transported from the sheet discharge path on the upstream side to the stack tray on the downstream side in this order.

Further, in Patent Document 2 (Japanese Patent Gazette No. 4901082 (FIG. 1)), a stack tray is disposed with a height difference formed on the downstream side of a sheet carry-in path, and a sheet dropping from a sheet discharge outlet onto a tray load surface is temporarily mounted and held on a support member (sub-tray) disposed in the middle portion in the height difference. Then, a post-processing apparatus is disclosed in which the support member is configured to be able to shift between an actuation position above the tray load surface and a waiting position retracted to the outside of the tray.

It is possible to make the apparatus small and compact by adopting such a configuration for temporarily collecting sheets dropping from the sheet discharge outlet on the support member proceeding above the tray to perform post-processing, and then retracting the support member to the outside of the tray to store.

SUMMARY OF THE INVENTION

As described above, such a post-processing mechanism is already known in Patent Document 2 and the like that the sub-tray (hereafter, referred to as the "support member") is disposed between the sheet discharge outlet and the tray paper mount surface to be able to move back and forth between the outside of the tray and the inside of the tray, and is retracted to the outside of the tray after collating sheets fed from the sheet discharge outlet on the sub-tray and performing post-processing.

Such a post-processing apparatus requires an alignment mechanism for positioning sheets (bunch) carried onto the support member from the sheet discharge outlet in a predetermined processing position. One of methods known as the alignment mechanism is the method of providing the support member (tray member) with a position regulation stopper in the sheet width direction, sheet carry means (alignment plate or the like), position regulation stopper in the sheet front end direction, and sheet carry means (roller body or the like), shifting the sheets in the transport direction to strike and regulate, and then, shifting the sheets in the width direction to strike and regulate. Further, in the different method, a transport rotating body is provided in a crossing direction inclined a predetermined angle (for example, 45-degree inclined direction) with respect to the sheet discharge direction, and the sheet side edge and sheet front edge strike the stoppers at the same time by the transport body.

The former positioning mechanism is complicated in which the sheets carried in the tray member are positioned at the front end in the transport direction by a plurality of transport means, and then, are positioned in the sheet width direction, and the problem is known that it takes a time to perform positioning of the sheets at the same time. Further, in the latter mechanism in which the transport body is disposed in the crossing direction to strike and regulate the front end and side edge of the sheets at the same time, the following defects are known. In other words, when a sheet is fed from the sheet discharge outlet while being skewed or is carried out while leaning to one side of the left or right, there is the problem that the sheet first striking one of the stoppers causes a distorted curl, folded end or the like and is not positioned in a correct posture.

Then, the inventor of the present invention arrived at the idea of providing the support member such as the sub-tray with transport means for shifting sheets in the direction crossing the sheet discharge direction, causing slide transport between the sheets and transport mechanism in causing the sheets to strike regulation stoppers at the side edge and front end to regulate, and thereby enabling the problems of inclination of the sheet, skew alignment, curl folded end and the like to be resolved.

It is an object of the present invention to provide a sheet storage apparatus that temporarily mounts sheets fed from a sheet discharge outlet on support means and that enables the sheets to be positioned in a correct position in a correction posture with a simplified paper feed mechanism. Further, it is another object of the invention to configure a sheet storage apparatus, which collates image-formed sheets carried out to the sheet discharge outlet to perform post-processing and then stores on the stack tray, in small and compact size with a simplified mechanism.

To attain the above-mentioned objects, in the invention are disposed support means to mount at least a part of a sheet between a sheet discharge outlet and a stack tray disposed with a height difference formed vertically, sheet end regulation means for striking an end edge of the sheet supported by the support means to regulate, and aligning transport means for shifting the sheet toward the regulation means. Then, the transport means is comprised of a friction transport body that engages in the sheet top surface on the support means, and transport body travel means for shifting the transport body by a predetermined amount in a crossing direction inclined a predetermined angle with respect to the sheet discharge direction. It is a feature to configure the friction transport body so that friction drag of the sheet surface is smaller in the travel orthogonal direction than in the travel direction.

In the travel direction and travel orthogonal direction, the above-mentioned friction transport body is set so that friction drag acting on between the sheet surface and the transport body is large in the former (travel direction), while being small in latter (the travel orthogonal direction). In other words, the friction force acting on between the sheets and the transport body engaging in the sheets is the same in the travel direction and in the travel orthogonal direction. At this point, when the transport friction body and the sheets move relatively, as in friction drag in hydrodynamics, it is possible to vary motion resistance in the travel direction and in the orthogonal direction by either of the following methods.

(1) The friction transport body is comprised of a roll body, and the roll body is supported to be able to perform rolling motion in the travel orthogonal direction with the rotating shaft in the travel direction as the center (Embodiment 1 described later).
(2) A support arm that holds the friction transport body is configured to be rotatable in the travel orthogonal direction (Embodiment 2 described later).
(3) The friction transport body is comprised of a ball-shaped sphere, and its support holder is provided with a brake member providing a large breaking force in the travel direction and a small breaking force in the travel orthogonal direction (Embodiment 3 described later).
(4) In the material (rubber material) constituting the friction transport body, the coefficient of friction in the X-axis direction and the coefficient of friction in the Y-axis direction are made different from each other (Embodiment 4 described later).

Further, the configuration will be described specifically. The apparatus is provided with a sheet discharge path (sheet carry-in path 11 described later) having a sheet discharge outlet, a stack tray 15 disposed on the downstream side of the sheet discharge outlet, support means (first and second support members 19, 20 described later) disposed between the sheet discharge outlet and the stack tray to load at least a part of a sheet, sheet end regulation means (rear end regulation stopper 24 and side edge regulation stopper 25 described later) that regulate a position of at least one end edge of the sheet supported by the support means, and aligning transport means 26 disposed in the support means to carry the sheet toward the sheet end regulation means.

The aligning transport means is comprised of a friction transport body 27 that engages in the top surface of the sheet supported by the support means, and transport body travel means 28 for shifting the friction transport body along the sheet surface by a predetermined amount in a travel direction crossing the sheet discharge direction at a predetermined angle, and the friction transport body is configured so that friction drag of the sheet surface on the support means is smaller in the travel orthogonal direction than in the travel direction.

In the invention, sheets are dragged and transported by the friction transport body traveling in the direction crossing the sheet discharge direction at a predetermined angle to strike the regulation stopper. At this point, the friction transport body is configured so that friction drag of the sheet surface is smaller in the travel orthogonal direction than in the travel direction, and therefore, the invention exhibits the following effects.

The friction transport body drags and transports sheets in the crossing direction inclined a predetermined angle with respect to the sheet discharge direction, and the sheets are carried toward the regulation stoppers (may be either one) of two directions disposed in the side edge direction and the sheet discharge direction. By this means, it is not necessary to provide the support tray with both the transport mechanism for carrying the sheets in the sheet discharge direction and the transport mechanism for carrying in the sheet width direction, and it is thereby possible to decrease in size and simplify the transport mechanism for positioning sheets in a predetermined processing position.

In this case, when the sheet is transported (skew-transported) while being skewed, alignment timing between the sheet rear edge and stopper regulation surface may go out of order to be earlier or later. When the sheet side edge strikes earlier, there is a fear that the sheet warps and is curled, and the folded end and the like may occur. At this point, the friction transport body is configured (floating roller structure, revolving rotation structure, slide friction surface structure) so as to reduce friction drag between the sheet surface and the friction transport body in the direction orthogonal to the travel direction. Accordingly, when the sheet strikes the regulation surface and is curved, the friction transport body shifts in the direction (direction for reducing curved deformation of the sheet) separating from the curved deformed portion by the curving deformation force, and does not cause problems such as curl and folding.

DETAILED DESCRIPTION OF THE INVENTION

Figure 1:
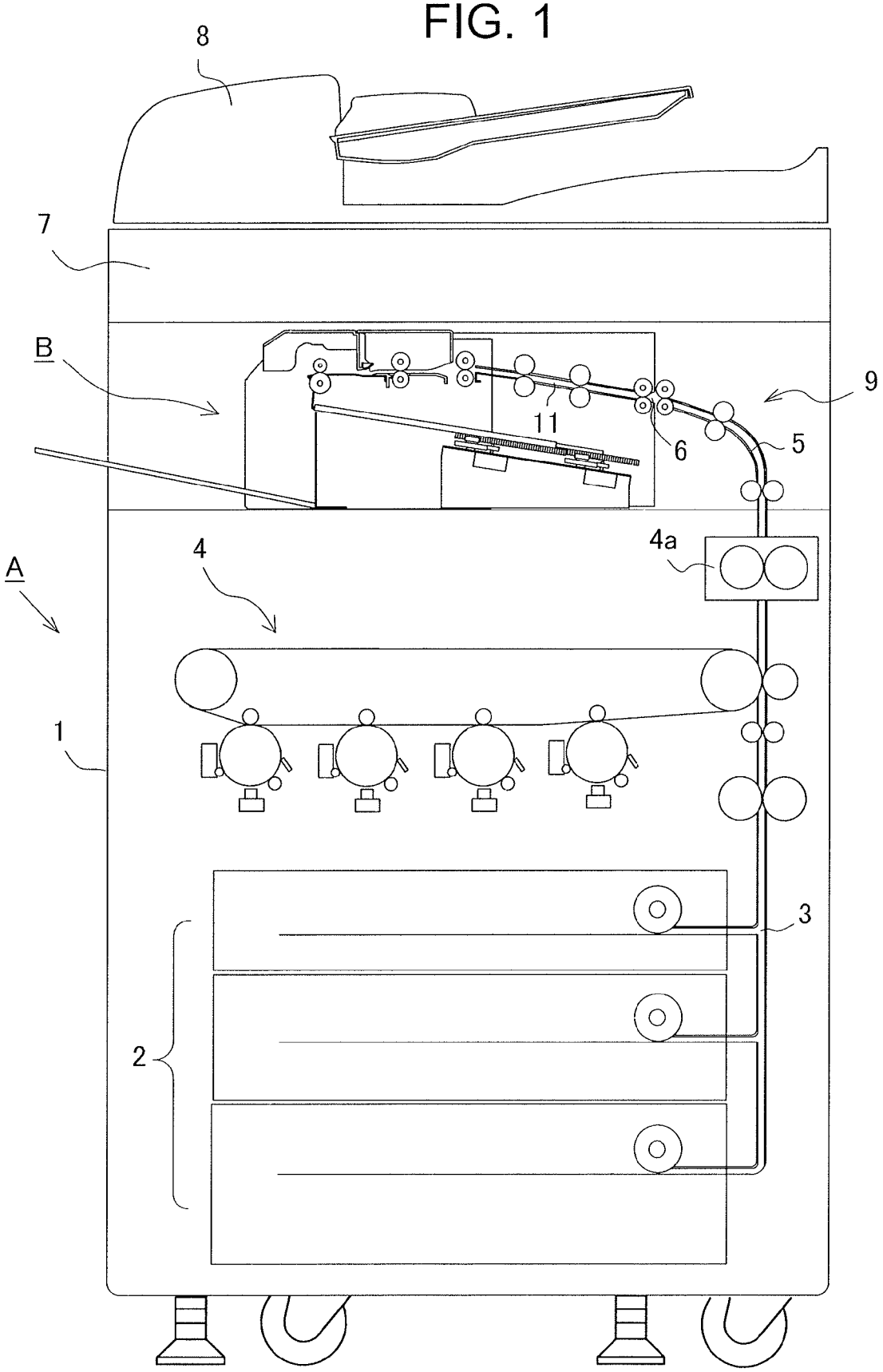
FIG. 1 is an explanatory view of the entire configuration of an image formation system according to the present invention.

The present invention will specifically be described below based on preferred Embodiments shown in drawings. FIG. 1 shows the entire configuration of an image formation system according to the invention, and is comprised of an image formation apparatus A that forms an image on a sheet, and a post-processing apparatus B that performs post-processing such as binding processing and jog sort processing on sheets with images formed in the image formation apparatus A to store on a stack tray 15 on the downstream side. A sheet storage apparatus C is incorporated into the post-processing apparatus B.

The image formation apparatus A is capable of adopting various image formation mechanism such as an inkjet printing mechanism and offset printing mechanism as well as an electrostatic printing mechanism described later. The post-processing apparatus B is capable of adopting processing mechanisms of a paper folding apparatus, magazine folding apparatus, punching apparatus, stamping apparatus and the like as well as a staple binding processing apparatus described later.

[Image Formation Apparatus]

The image formation apparatus A as shown in FIG. 1 is coupled to an image handling apparatus such as a computer and network scanner not shown, and forms an image on a designated sheet based on image data transferred from these apparatuses to carry out of a predetermined sheet discharge outlet 6. In the sheet discharge outlet 6 is provided a sheet discharge tray to load and store sheets. As a substitute for the sheet discharge tray, the post-processing apparatus B is installed as an optional apparatus. Further, as well as such a network configuration, the image formation apparatus A is configured as a copier or facsimile, and is configured to copy and form an image on a sheet based on data obtained by reading an image with an original document scanning unit.

In the image formation apparatus A, a plurality of paper feed cassettes 2 is prepared in a housing 1, and a sheet of the selected size is fed from the cassette to a paper feed path 3 on the downstream side. In the paper feed path 3 is provided an image formation mechanism (image formation section) 4. Known as the image formation mechanism 4 are the inkjet printing mechanism, electrostatic printing mechanism, offset printing mechanism, silk screen printing mechanism, ribbon transfer printing mechanism and the like. The present invention is capable of adopting any printing mechanism.

A sheet discharge path 5 is provided on the downstream side of the image formation mechanism 4, and a sheet is carried out of the sheet discharge outlet 6 (hereinafter, referred to as a main-body sheet discharge outlet) disposed in the housing 1. In addition, depending on the printing mechanism, a fuse unit 4*a* is incorporated into the sheet discharge path 5. The sheet of the selected size is thus fed to the image formation section 4 from the paper feed cassette 2, and after forming the image, is carried out to the main-body sheet discharge outlet 6 from the sheet discharge path 5. Moreover, when a duplex path (not shown) is disposed inside the housing 1, after forming an image on the frontside of the sheet in the image formation section 4, it is also possible to reverse the side of the sheet to circulate and feed again to the image formation section 4.

The main-body sheet discharge outlet 6 is coupled to the post-processing apparatus B described later. Further, into the housing 1 are incorporated a scanner unit 7, and an original document feed unit 8 that feeds an original document sheet to the scanner unit 7. In this case, the scanner unit 7 scans the original document sheet placed on platen or fed from a feeder mechanism to read the image, and transfers the read data to the image formation apparatus A. Further, the original document feed unit 8 is provided with the feeder mechanism that feeds an original document sheet to the platen of the scanner unit 7.

[Post-processing Apparatus]

Figure 2:
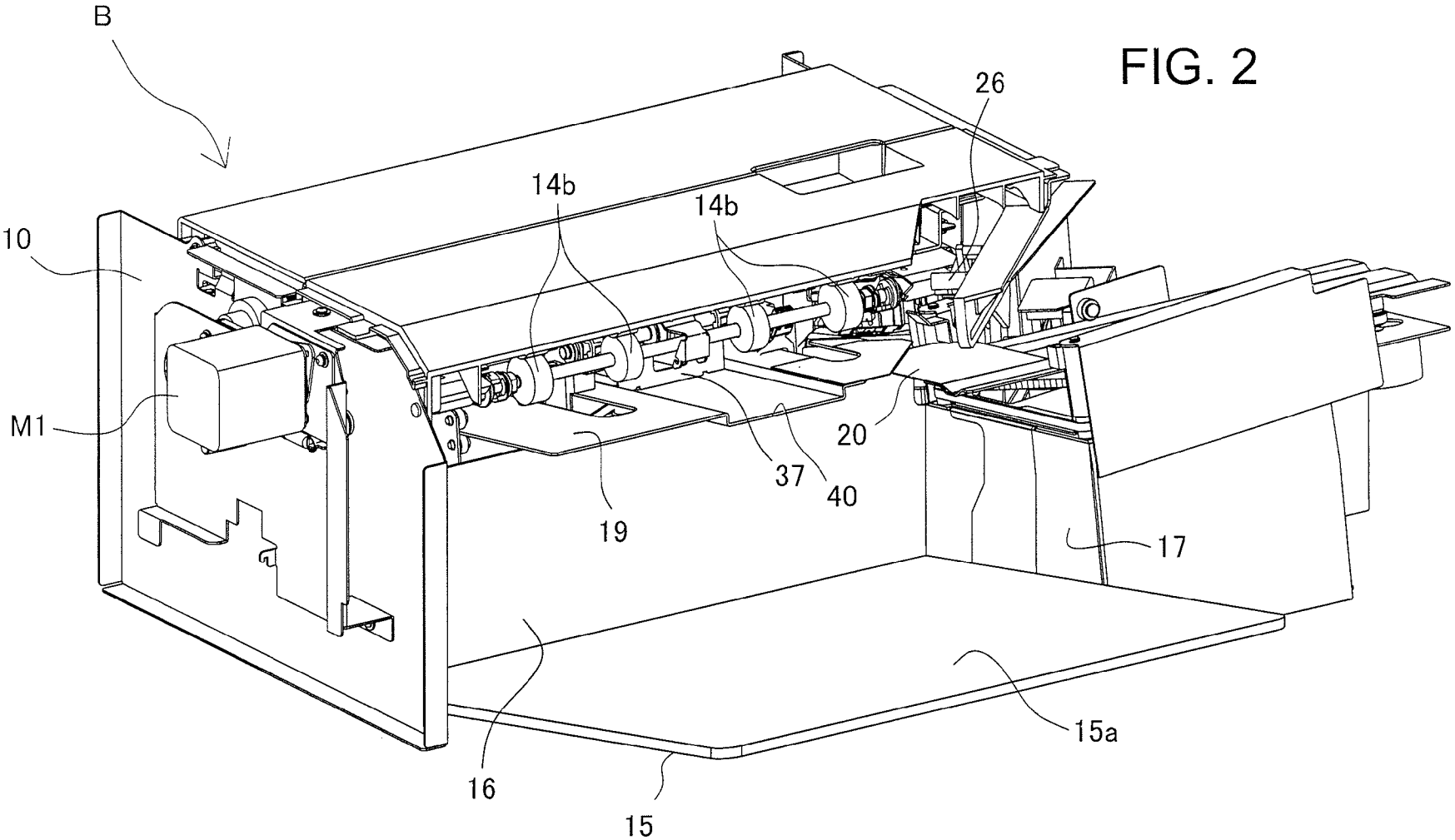
FIG. 2 is a perspective explanatory view of the entire configuration of a post-processing apparatus (sheet storage apparatus) in the image formation system of FIG. 1.

The post-processing apparatus B in the image formation system of FIG. 1 is incorporated into a sheet discharge area 9 of the image formation apparatus A as an optional apparatus. In other words, the post-processing apparatus B is incorporated into a sheet discharge section of the apparatus housing constituting the image formation apparatus A as a unit of inner finisher structure. The present invention is not limited to such an inner finisher structure, and the post-processing apparatus B may be configured as a standalone structure and coupled to the main-body sheet discharge outlet 6 of the image formation apparatus A. FIG. 2 shows a perspective configuration of the post-processing apparatus B of the inner finisher configuration. A housing 10 constituting the unit is configured in a dimensional shape capable of being incorporated into the sheet discharge area 9 of the image formation apparatus A.

Figure 3A:
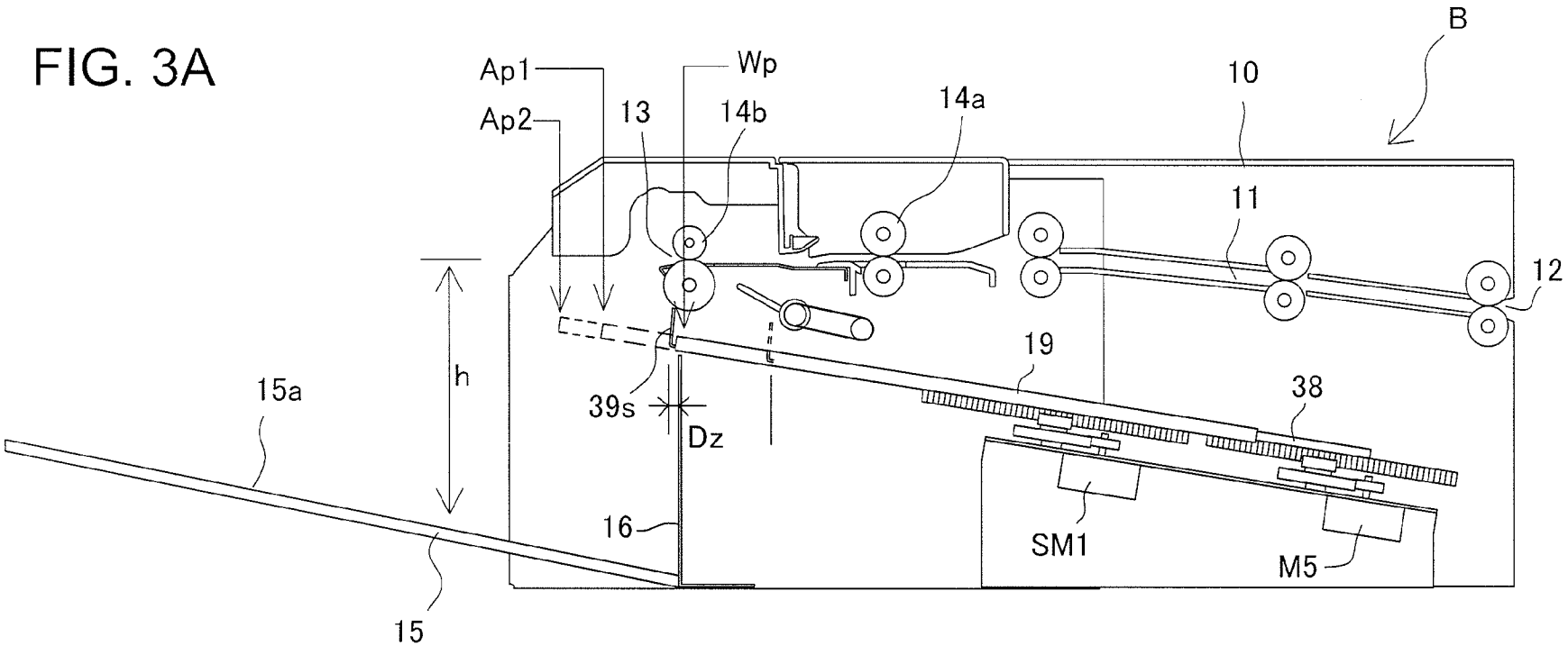
FIG. 3A is an explanatory view of a cross-sectional configuration in the post-processing apparatus in the system of FIG. 1.

FIG. 3A shows a cross-sectional configuration thereof, and the post-processing apparatus B is provided with a sheet carry-in path 11 to carry a sheet in from the image formation apparatus A, and the stack tray 15 disposed on the downstream side of the path. A height difference with a difference in height h is formed between a path sheet discharge outlet 13 (hereinafter, simply referred to as a "sheet discharge outlet") of the sheet carry-in path 11 and a paper mount surface 15*a* of the stack tray 15. The height difference h is set for an allowable maximum storage amount. In addition, the stack tray 15 shown in the figure adopts a stack structure fixed to a predetermined height difference without moving up and down in the load direction corresponding to a load amount of sheets. This is because of forming the apparatus configuration in small and compact size to be stored in the sheet discharge area 9 of limited space. Accordingly, when the apparatus cost and storage space are allowed, an up-and-down tray structure may be adopted to move the stack tray 15 up and down in the sheet load direction. In this case, the tray may be moved up and down corresponding to the weight of discharged sheets using an elastic member such as a spring, or drive to move the tray up and down may be used.

The sheet carry-in path 11 is disposed in the substantially horizontal direction in the housing 10, and transports a sheet from the carry-in entrance 12 to the sheet discharge outlet 13. Therefore, in the sheet carry-in path 11 are provided a sheet transport guide, a plurality of transport rollers 14*a* arranged at predetermined intervals, and carry-in sensor Se1 and sheet discharge sensor Se2 that detect the front and rear ends of the sheet. Then, the transport rollers 14*a* are coupled to a transport motor M1 not shown. "14*b*" shown in the figure denotes a sheet discharge roller disposed on the path exist end, and is coupled to the same transport motor M1 as that of the transport rollers 14*a*.

[Stack Tray]

The configuration of the stack tray 15 will be described according to FIG. 2. The stack tray 15 is fixed to the apparatus frame 10 (housing; the same in the following description), and has the paper mount surface 15*a* to load and accommodate sheets fed from the sheet discharge outlet 13. In the apparatus shown in the figure, the tray is of mold forming of a synthetic resin and is fixed to the apparatus frame 10 in the shape of a tray on which sheets are mounted (cantilever support structure). The height difference with the difference in height h is formed between the sheet discharge outlet 13 and the paper mount surface 15*a*, and a rear end regulation surface (sheet rear end regulation surface) 16 and side edge regulation surface 17 are provided in wall surface structure in between the sheet discharge outlet 13 and the paper mount surface 15*a*. In each regulation surface, the rear end regulation surface 16 regulates the rear end surface of sheets loaded on the paper mount surface, and the side edge regulation surface 17 regulates the side edge surface of the sheets.

In addition, the paper mount surface 15*a* of the stack tray 15 is configured in fixed tray structure having the difference in height h from the sheet discharge outlet 13 as shown in FIG. 3A. In this case, the difference in height h is set at a height adapted to the maximum load amount capable of being held. Moreover, the stack tray 15 may be configured to move up and down in the sheet load direction in the apparatus frame 10, and the up-and-down tray structure may be adopted to adjust the height position of the paper mount surface 15*a* upward and downward corresponding to the load amount of sheets carried out of the sheet discharge outlet 13.

[Sub-tray]

Figure 4A:
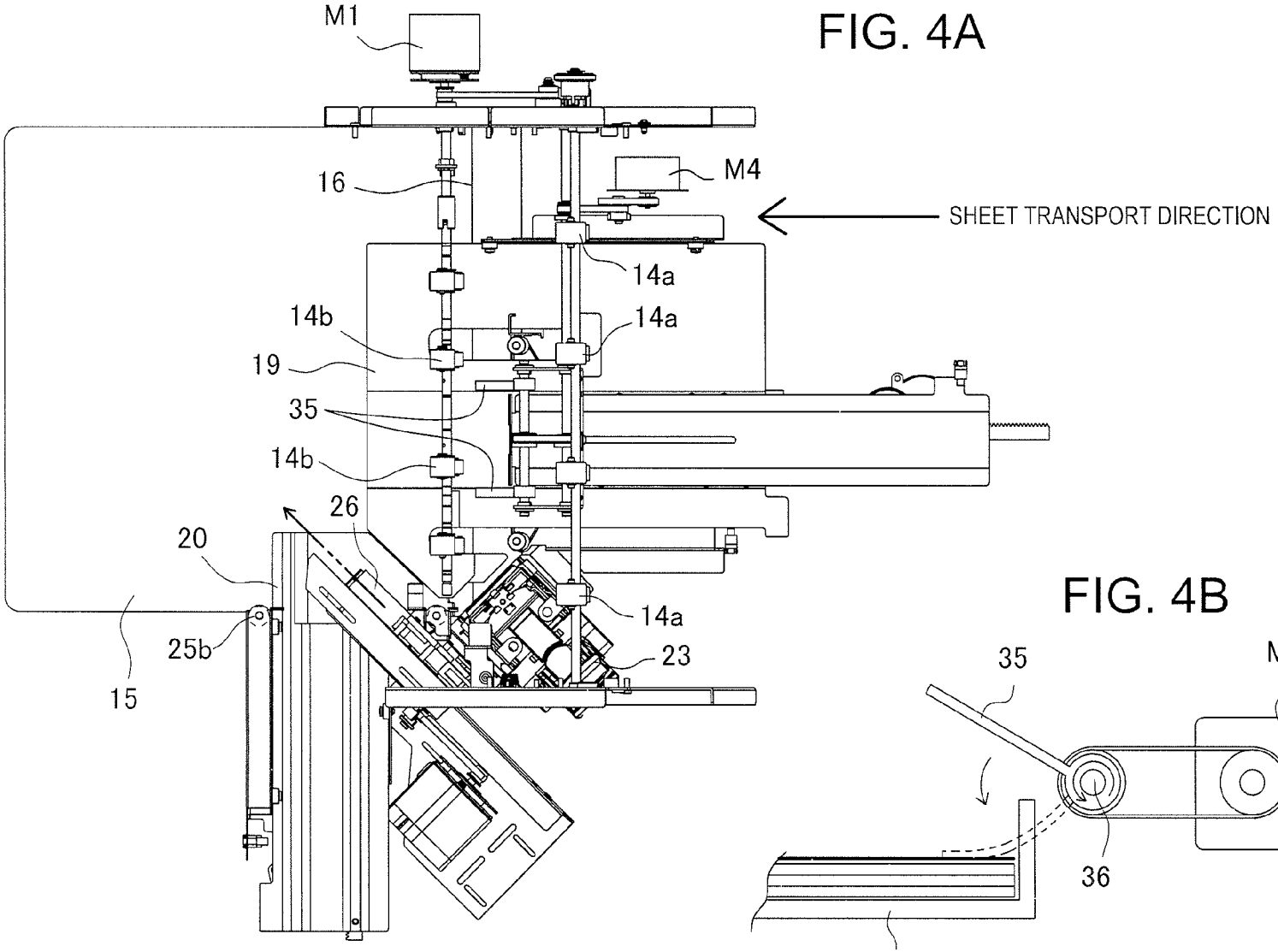
FIG. 4A is an explanatory view of the plan configuration of the post-processing apparatus in the system of FIG. 1.
Figure 5A:
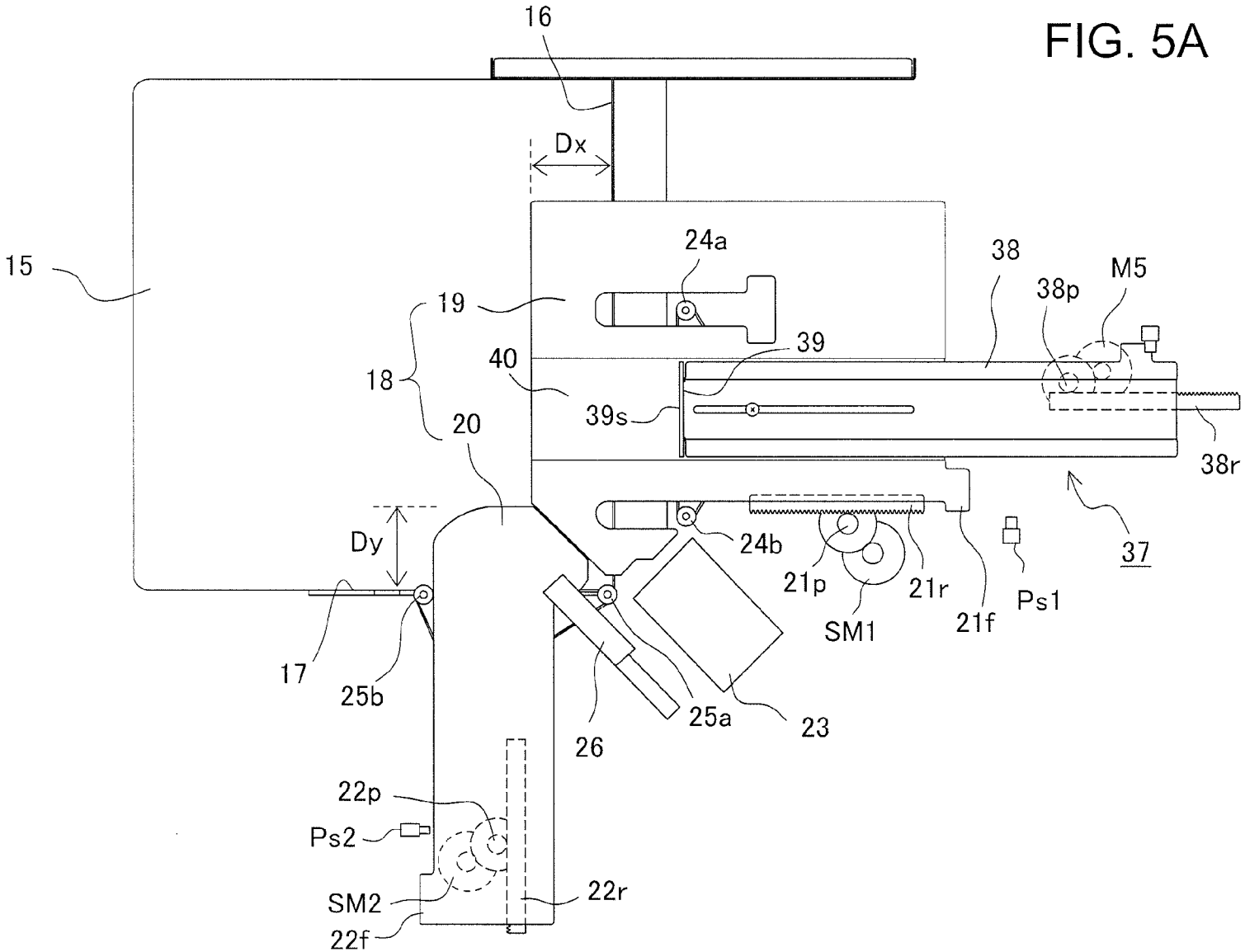
FIG. 5A is a structure explanatory view of a sub-tray in the invention.

As shown in FIGS. 2, 3A and 5A, a sub-tray 18 is disposed between the sheet discharge outlet 13 and the paper mount surface 15*a*. The sub-tray 18 temporarily supports sheets dropping onto the paper mount surface 15*a* from the sheet discharge outlet 13 to be mounted in the middle position, performs post-processing on the sheets and then stores on the paper mount surface 15*a*. The configuration of the post-processing will be described later. FIG. 4A shows the plan configuration of the sheet discharge outlet 13 and stack tray 15, and is a schematic view with the transport guide constituting the sheet carry-in path 11 omitted. The sheet carry-in path (not shown) is disposed from the right side to the left side as viewed in the figure, and the transport rollers 14*a* and sheet discharge roller 14*b* carry the sheet coming from the carry-in entrance 12 to the sheet discharge outlet 13. The sheet fed to the sheet discharge outlet 13 is collected on the paper mount surface 15*a* of the stack tray 15, and is stacked with the sheet end surface regulated by the rear end regulation surface 16.

Figure 5B:
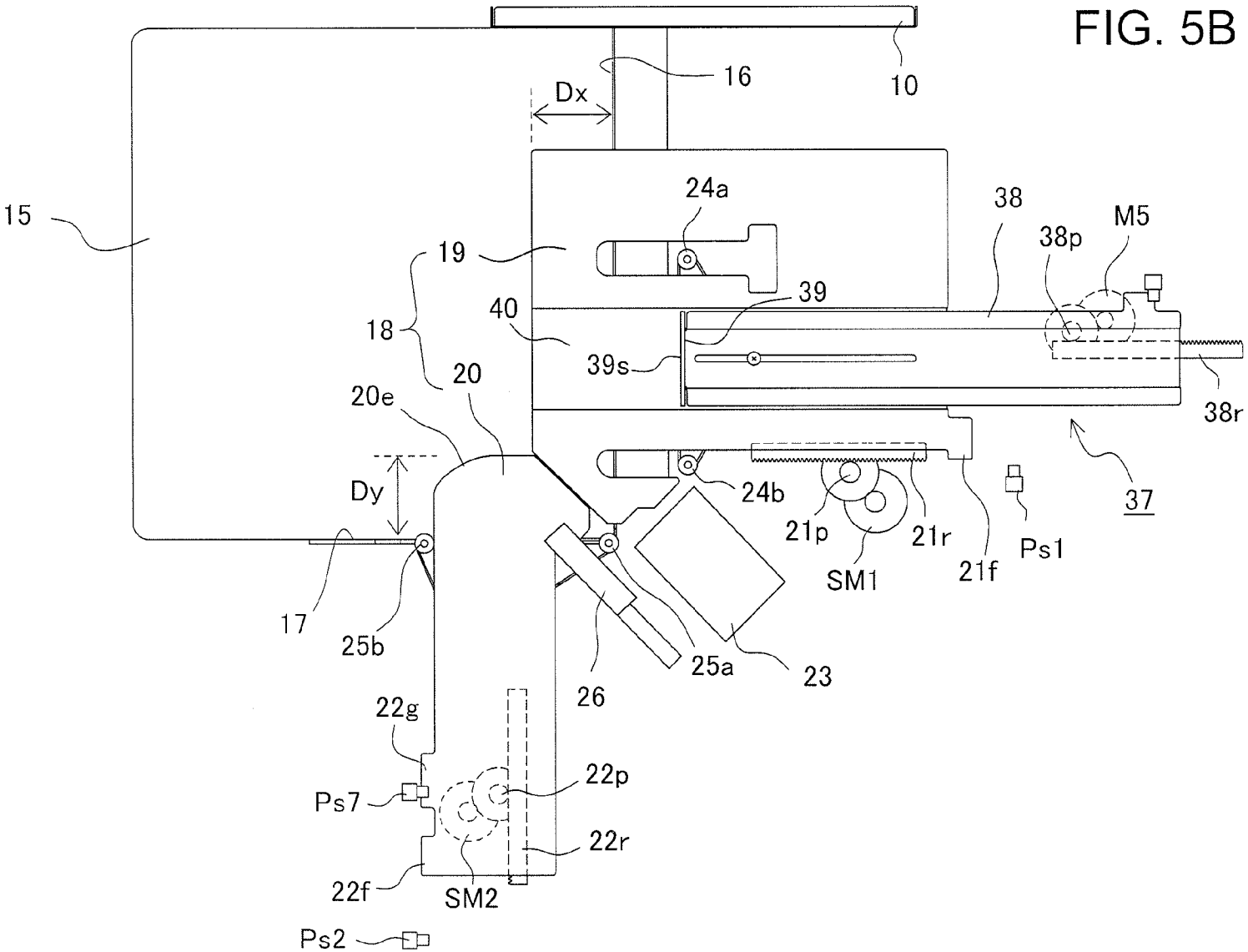
FIG. 5B is an explanatory view of a state with the sheet discharge mechanism in FIG. 4A omitted.

The sub-tray 18 partially supports the sheet fed from the sheet discharge outlet 13 and holds the sheet in this position. The sub-tray 18 shown in the figure is comprised of a rear end support member 19 (first support member) that supports the sheet rear end in the sheet discharge direction, and a side edge support member 20 (second support member) that supports one side edge portion (in the apparatus as shown in the figure, the left side edge portion in the sheet discharge direction) of the sheet. In FIGS. 5A and 5B, the rear end support member 19 protrudes by Dx from the rear end regulation surface 16 of the stack tray 15 to the inside of the tray, and the side edge support member 20 protrudes by Dy from the side edge regulation surface 17 to the inside of the tray. Then, the protrusion amounts Dx (protrusion amount of the first support member) and Dy (protraction amount of the second support member) are formed in areas allowed to mount and support any of sheets of the maximum size to the minimum size and sheets of the maximum weighing to the minimum weighing on both support members.

Further, the first support member 19 and the second support member 20 are configured to be able to shift from actuation positions Ap (Ap1 or Ap2) protruding to the inside of the stack tray 15 and retract positions Wp (not protruding from any of the rear end regulation surface 16 and side edge regulation surface 17) retracted to the outside of the stack tray 15.

In other words, the first support member (rear end support member) 19 reciprocates between the actuation position Ap protruding to the inside of the stack tray 15 and the retract position Wp retracted to the outside of the stack tray 15 (inside the sheet rear end regulation surface 16; the right side in FIG. 4A). Similarly, the second support member (side end support member) 20 reciprocates between the actuation position Ap (position shown in the figure) protruding to the inside of the stack tray 15 and the retract position Wp retracted to the outside of the stack tray 15 (inside the sheet side edge regulation surface 17; the front side in FIG. 4A). This slide structure is capable of adopting various mechanisms, and in the apparatus as shown in the figure, the plate-shaped first and second support members 19, 20 are fitted into guide rails (not shown) formed in the apparatus frame 10 to be slidable with slide rollers and the like.

[Shift Mechanism]

The first support member (rear end support member) 19 is equipped with a first tray shift means 21, the second support member (side end support member) 20 is equipped with a second tray shift means 22, and the shift means drive respective support members 19, 20 to enable the members to reciprocate between the actuation positions Ap and the retract positions Wp. More specifically, the first support member 19 and the second support member 20 are supported by the apparatus frame 10 to be able to reciprocate between the actuation positions Ap and the retract positions Wp by predetermined strokes. The first tray shift means 21 and the second tray shift means 22 adopt the same configuration, and therefore, one of the means is described. FIGS. 5A and 5B are explanatory views illustrating the relationships between the first and second support members 19, 20 and the shift means 21, 22. With the description given according to the figures, a rack 21*r* is integrally formed on the back side of the first support member 19, and the support member 19 reciprocates with a first shift motor SM1 fixed to the apparatus frame 10, and a pinion 21*p* coupled to the motor. More specifically, the rack 21*r* is integrally formed on the back side of the first support member 19, and meshes with the pinion 21*p* axially supported by the apparatus frame 10. The pinion 21*p* is coupled to the first shift motor SM1, and forward and backward rotation of the motor causes the first support member 19 to reciprocate between the retract position Wp and the actuation position Ap.

In other words, the rack 21*r* integrally formed in the first support member (rear end support member) 19 reciprocates via the pinion 21*b* by forward and backward rotation of the first shift motor SM1. "21*f*" shown in the figure denotes a sensor flag disposed in the support member 19, and is to detect a position (for example, home position; retract position) of the support member 19 using a position sensor Ps1 disposed in the apparatus frame 10. In addition, the shift motor SM1 is comprised of a stepping motor capable of rotating forward and backward, and for example, is allowed to control the support member 19 by a predetermined amount in the predetermined direction by PMW control. The second support member (side end support member) 20 has the same configuration, and is shifted from the actuation position Ap to the retract position Wp. Therefore, the second support member 20 is provided with a second shift motor SM2, second pinion 22*p*, second rack 22*r*, second position sensor Ps2 and second sensor flag 22*f*.

As described in FIGS. 4A, 5A and 5B, the sub-tray 18 is disposed between the sheet discharge outlet 13 and the stack tray 15, and the sub-tray 18 shown in the figure is comprised of the first support member (rear end support member) 19 and the second support member (side end support member) 20. Further, the support members 19, 20 shift from the actuation positions Ap inside the path (shift trajectory) to the waiting position Wp outside the path (shift trajectory) with respect to the shift path (drop trajectory) of the sheet from the sheet discharge outlet 13 to the stack tray 15 by the shift motors SM1 and SM2, respectively. Reference numeral "23" shown in the figure denotes a post-processing unit, and is a staple unit for performing binding processing on a bunch of sheets that are collated and collected on the first and second support members 19, 20.

As the staple unit 23 (post-processing means; the same in the following description), various structures are known, and the description thereof is omitted. A blank staple stored in a cartridge is bent in the shape of a U and is inserted into a bunch of sheets, and the staple tips are bent by an anvil. In addition, as a substitute for the staple unit, or together with the unit, it is possible to install a punch unit that punches a punch hole in a bunch of collated sheets, stamp unit and the like as the post-processing apparatus.

[Regulation Stopper]

In the sub-tray 18 (first and second support members 19, 20) as described previously, stopper members are provided to regulate the position of the end edge of sheets that are placed and supported. In the first support member (rear end support member) 19 is disposed a rear end regulation stopper 24 that regulates the sheet rear end, and in the second support member (side end support member) 20 is disposed a side edge regulation stopper 25 that regulates the sheet side edge. The regulation stoppers 24, 25 shown in the figure are comprised of pluralities of floating rollers 24*a*, 24*b* and floating rollers 25*a*, 25*b* having distances, respectively and are axially supported by the apparatus frame 10 to be rotatable.

Then, each floating roller (regulation stopper) 24 (25) engages in the edge side of the sheets, and when the sheets shift, rotates in the shift direction. In this case, by forcibly rotating a plurality of rollers in a predetermined direction, it is possible to perform alignment of sheets more correctly and promptly. For example, the floating roller 24*a* and the roller 24*b* are interlocked with a belt 24*v*, and a drive motor M6 (see FIG. 11A) is coupled to the belt 24*v*. By thus configuring, the sheets are shifted in the alignment direction in cooperation with an aligning transport means (sheet carry means) 26 described late, and are aligned in a more correct position. Moreover, the regulation stoppers 24, 25 may be formed by height difference surfaces. For example, a height difference portion, protrusion or the like is integrally formed in each of the support members 19, 20, the end surface is made a regulation surface, and thus, it is possible to adopt various structures.

In each of the regulation stoppers 24, 25, in a second sheet discharge mode (and a part of a third sheet discharge mode) described later, the sheet rear end is struck by the rear end stopper 24 to regulate, the sheet side edge is struck by the side edge stopper 25 to regulate, and the sheets are positioned in a binding processing position. Further, in the third sheet discharge mode described later, the sheet side edge is struck by the side edge stopper 25 to regulate, and the sheets are positioned in a jog offset position. In addition, in the Embodiment shown in the figure in the third sheet discharge mode, the sheet rear end edge is struck by the rear end stopper 24 to regulate concurrently with the sheet side edge, but such a configuration is not inevitable (in other words, in the third sheet discharge mode, the rear end regulation stopper 24 may be retracted from the first support member (rear end support member) 19).

[Configuration of the Aligning Transport Means (Sheet Carry Means]

As shown in FIG. 4A, the aligning transport means (sheet carry means) 26 is disposed in the apparatus frame 10 to carry the sheet placed and supported on the first support member (rear end support member) 19 and the second support member (side end support member) 20 toward the rear end regulation stopper 24 and the side edge regulation stopper 25. With respect to the sheet carried out to the sheet discharge outlet 13 by the sheet discharge rollers 14*b*, when the sheet rear end is separated from the roller periphery, the sheet drops onto the first and second support members 19, 20 and is placed in a free state. The aligning transport means 26 that transports the sheet backward to the rear end regulation stopper 24 and the side edge regulation stopper 25 is disposed in a corner portion (right end in FIG. 4A) of the first and second support members 19, 20.

In the apparatus shown in the figure, the aligning transport means (sheet carry means) 26 is disposed on the second support member (side end support member) 20, and is disposed to transport backward the sheets placed on the first support member (rear end support member) 19 and the second support member 20 in the arrow inverse direction (sheet corner direction) in FIG. 4A. The aligning transport means 26 may be disposed on the first support member 19, and described is the case where the means 26 is disposed on the second support member 20 as shown in the figure.

The aligning transport means (sheet carry means) 26 is comprised of a friction transport body 27 that engages in the top surface of a sheet supported by the first and second members 19, 20, and a transport body travel means (transport arm member, manipulator) 28 to cause the friction transport body to travel in an angle direction crossing the sheet discharge direction in the sheet-discharge opposite direction.

Figure 6:
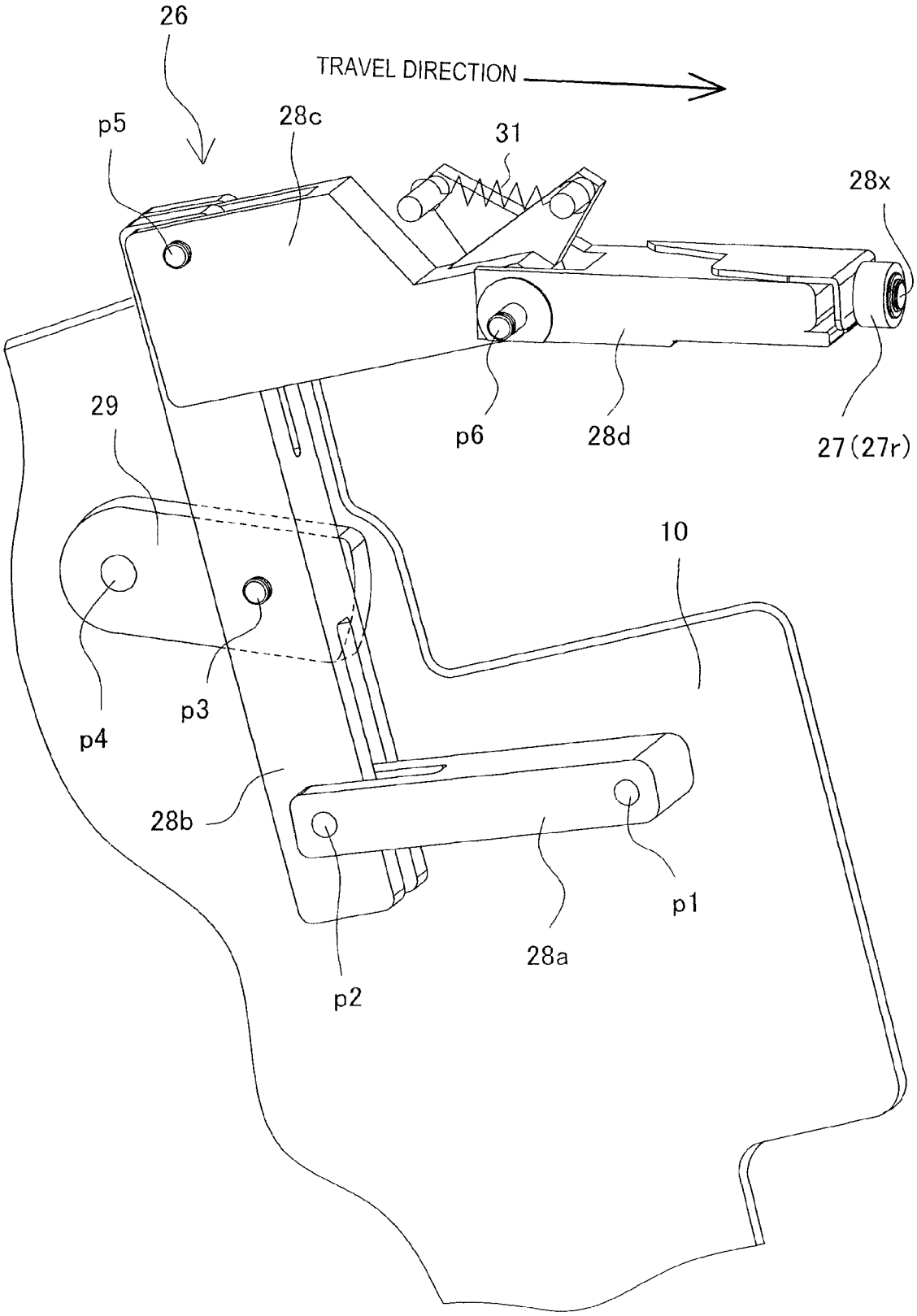
FIG. 6 shows Embodiment 1 (rotating body and inch worm motion mechanism) of a friction transport body in the apparatus of FIG. 2.

The friction transport body 27 engages in the sheet top surface supported on the support member 20, and shifts the sheet in the travel direction of the transport body by the friction force acting on both. Therefore, the friction transport body is formed of a high friction material such as a rubber material and resin material, and its shape is formed in the shape of a pad (rectangle), the shape of a roll, the shape of a half roll (the shape of a semicircle), the shape of a sphere or the like. The Embodiment in FIG. 6 shows the case where the body is comprised of a floating roller (the shape of a roll). Then, the friction transport body is mount-supported by a holder member (transport body travel means (transport arm member, manipulator) 28 described below; the same in the following description).

FIGS. 7A, 7B, 8A and 8B show the transport body travel means (transport arm, member) 28 that shifts the friction transport body 27 to a waiting position Wu retracted from sheets on the support member 20 and an engagement position Ad for engaging in the sheet top surface in a predetermined carry direction (X direction) while engaging in the sheet top surface so as to drag and transport the sheets. The transport body travel means 28 shown in the figure is comprised of a manipulator 28 installed in the apparatus frame 10.

The manipulator (transport arm member, transport body travel means) 28 is comprised of a first arm 28*a*, a second arm 28*b* axially supported by the first arm to be swingable, a third arm 28*c* axially supported by the front end portion of the second arm, and an actuation arm 28*d* axially supported by the front end portion of the third arm. In other words, the manipulator 28 is comprised of an arm coupling body (link coupling) of four-axis configuration, the first arm 28*a* is axially supported by the apparatus frame 10, the second arm 28*b* is coupled to a drive arm 29, motion of the third arm 28*c* is regulated with a guide groove 30 of the apparatus frame 10, and the friction transport body 27 is fixed to the front end of the actuation arm 28*d* axially supported by the third arm 28*c*.

In FIG. 6, "p1" denotes a rotating pin that axially supports the first arm 28*a* on the apparatus frame 10 to be swingable, and "p2" denotes a rotating pin that axially supports the base end portion of the second arm 28 on the first arm front end. "p3" denotes a rotating pin that axially couples the front end of the drive arm 29 to the second arm 28*b* to be rotatable, and the drive arm 29 is coupled to a travel motor M3. "p4" denotes a drive shaft that axially supports the drive arm 29 on the apparatus frame 10 to be rotatable. The drive shaft p4 is coupled to the travel motor M3 via a deceleration mechanism. Accordingly, when the drive arm 29 rotates in a counterclockwise direction with the drive shaft P4 as the center by the travel motor M3, the friction transport body 27 mounted on the actuation arm 28*d* turns and rotates in right rotation in FIG. 6.

Further, "p5" denotes a rotating pin that axially supports the third arm 28*c* on the front end of the second arm 28*b* to be rotatable, and "p6" denotes a rotating pin that axially supports the base end of the actuation arm 28*d* on the front end of the third arm 28*c* to be rotatable. Further, p6 works also as a guide pin fitted into the guide groove 30 provided in the apparatus frame 10. Then, the guide groove 30 of the apparatus frame 10 is configured in the shape of guiding the actuation arm 28 *d* to perform inch worm motion.

Furthermore, a biasing spring 31 for biasing the friction transport body 27 mounted on the actuation arm front end to the support member 20 side is laid between the third arm 28*c* and the actuation arm 28*d*. This is because of engaging the friction transport body 27 on the sheet surface always by nearly constant press force irrespective of the thickness (bunch thickness) of sheets loaded on the support member 20. The friction transport body 27 is comprised of a floating roller 27*r* in the shape of a roll, and is axially supported by the actuation arm 28*d* to be rotatable in the travel orthogonal direction by a roll support shaft 28*x* in the sheet travel direction (see FIG. 6) described later.

In addition, in the Embodiment in FIG. 6, as long as the floating roller 27*r* constituting the friction transport body 27 is in the substantially orthogonal direction to the travel direction, it is not technically inevitable to set the angle strictly. In other words, the angle can be approximately 90 degrees with respect to the travel direction of the friction transport body. Then, the rotating shaft angle of the floating roller 27*r* is set at angles in the range in which friction drag acting on the sheet surface in the travel direction of the friction transport body and the orthogonal direction is set to be large in the former while being small in the latter. In addition, herein, the friction drag is referred to as a resistance force by friction acting on a substance (the same as friction drag in hydrodynamics), and when the friction drag is small, the substance shifts in the direction freely.

In addition, the travel motor. M3 is an angle control-capable motor such as a stepping motor and DC motor provided with an angle control mechanism such as an encoder. Then, by detecting a flag disposed in the motor rotating shaft with a sensor (not shown), the angle is set at a home position.

Figure 7A:
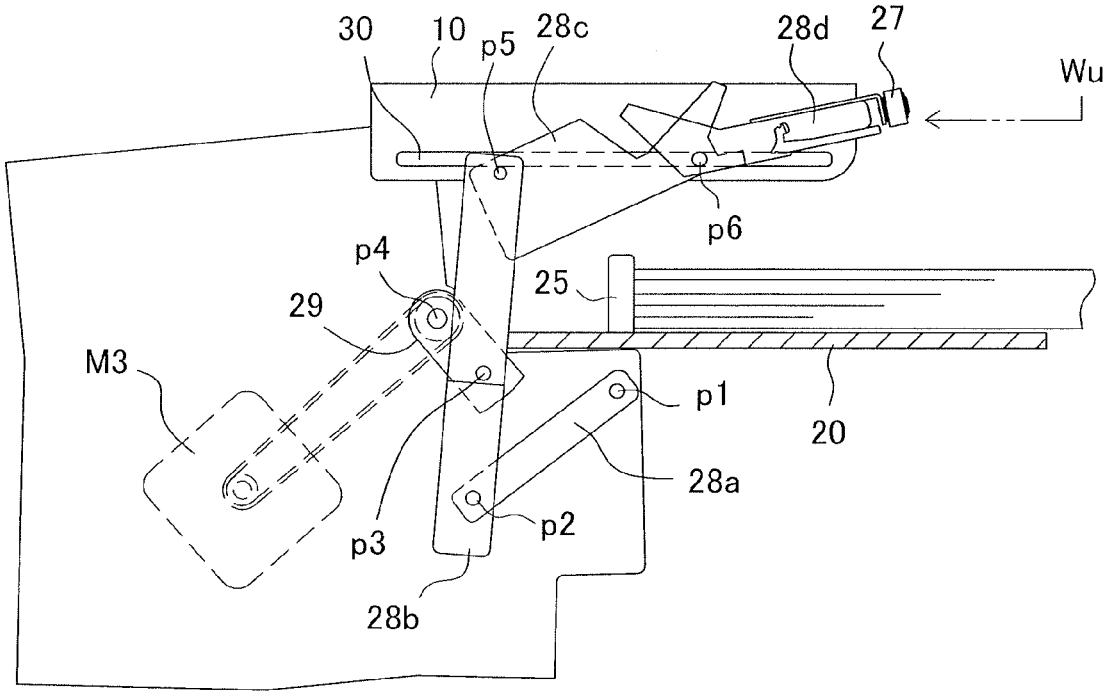
FIG. 7A is a view illustrating an operation state of a transport body travel means 28 in a home position.
Figure 7B:
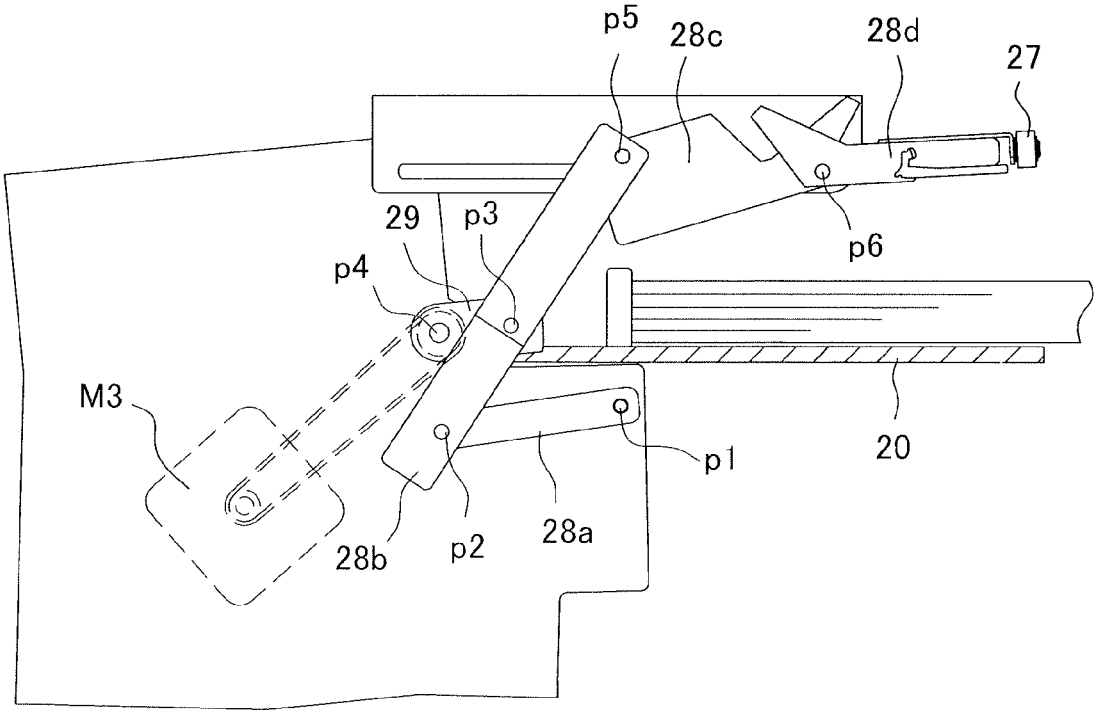
FIG. 7B is a view illustrating a state in which a drive motor of the transport body travel means 28 is rotated in a counterclockwise direction (about 90 degrees in the figure)

FIGS. 7A to 9B show operation states of the transport body travel means 28. FIG. 7A shows a home position, and the friction transport body 27 is positioned in a state of retracting above the uppermost sheet of the support member 20. At this point, the drive arm 29 is positioned at about 120 degrees in the state as shown in the figure. The angle of the drive arm does not have any technical relationship with motion of the transport body travel means 28, but is shown to describe link motion. FIG. 7B shows a state in which the travel motor M3 is rotated in a counterclockwise direction (about 90 degrees in the figure), and the friction transport body 27 at this point is positioned in a farthest position (right end in FIG. 7B) in the sheet discharge direction above the sheets on the support member 20. In other words, the body 27 is positioned in a link coupling state with the inch worm motion extended most.

Figure 8A:
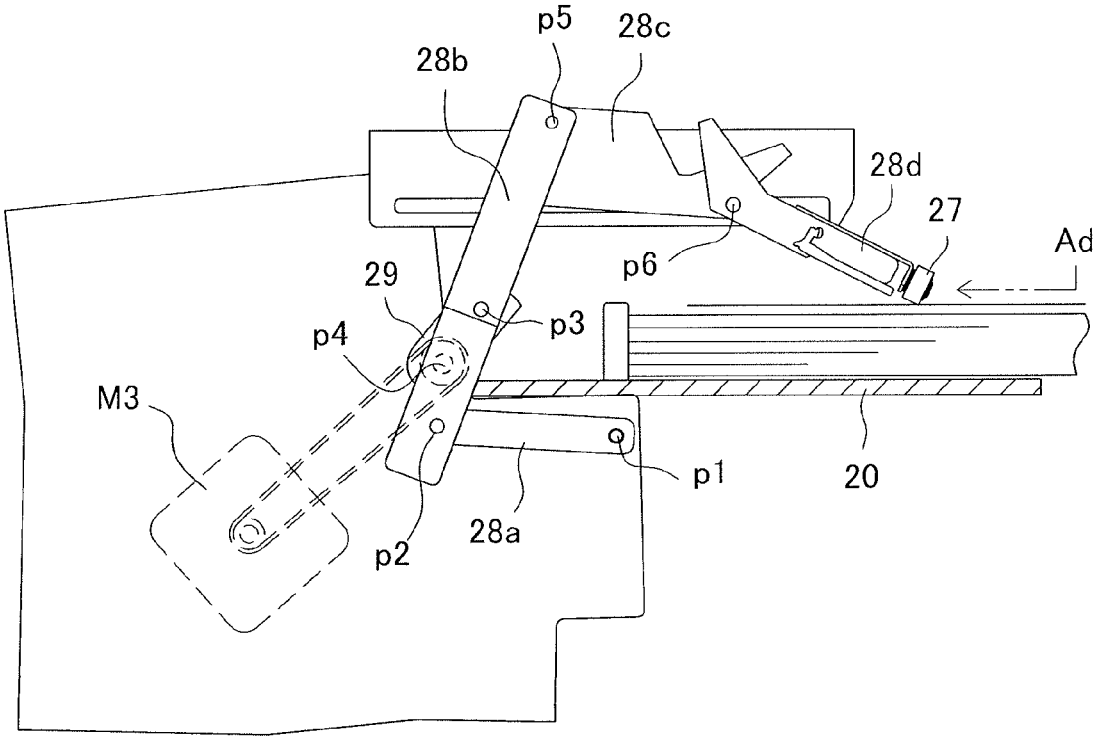
FIG. 8A is a view illustrating a state in which the transport body travel means 28 engages in (contacts) the uppermost sheet.

FIG. 8A shows a state in which the friction transport body 27 engages in (contacts) the uppermost sheet on the support member 20, and the drive arm 29 at this point rotates in a counterclockwise direction, and is positioned in an angle position of about 15 degrees. In this state, the biasing spring 31 between the actuation arm 28*d* and the third arm 28*c* provides the friction transport body 27 with the force for pressing the sheet top surface. Then, the spring 31 provides the friction transport body 27 with the almost uniform pressing force irrespective of the thickness of sheets stacked on the support member 20.

Figure 8B:
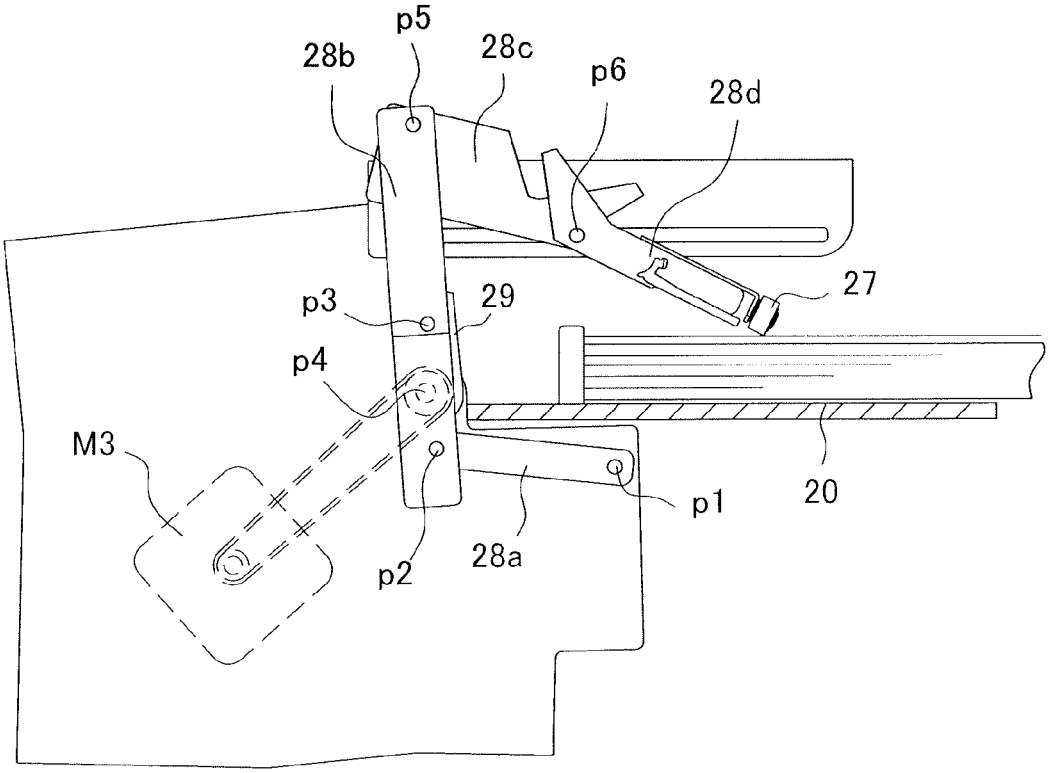
FIG. 8B is a view illustrating a state in which the drive motor of the transport body travel means 28 is further rotated in the counterclockwise direction (about 0 degree)

FIG. 8B is the case of rotating the travel motor M3 further in the counterclockwise direction (about 0 degree), and the friction transport body 27 shifts the sheets while dragging in the arrow direction in the figure. The second arm 28*b* and third arm 28*c* at this point are in the most contracted link coupling state. By such operation, the friction transport body 27 contacts the uppermost sheet surface in the state in FIG. 8A, travels and shifts to the position in FIG. 8B along the support surface to drag and transport the sheets, and causes the sheets to strike each regulation stopper. In other words, the friction force in the travel direction of the friction transport body 27 is set at a coefficient of friction allowed to obtain friction sufficiently higher than the friction force between sheets.

Figure 9A:
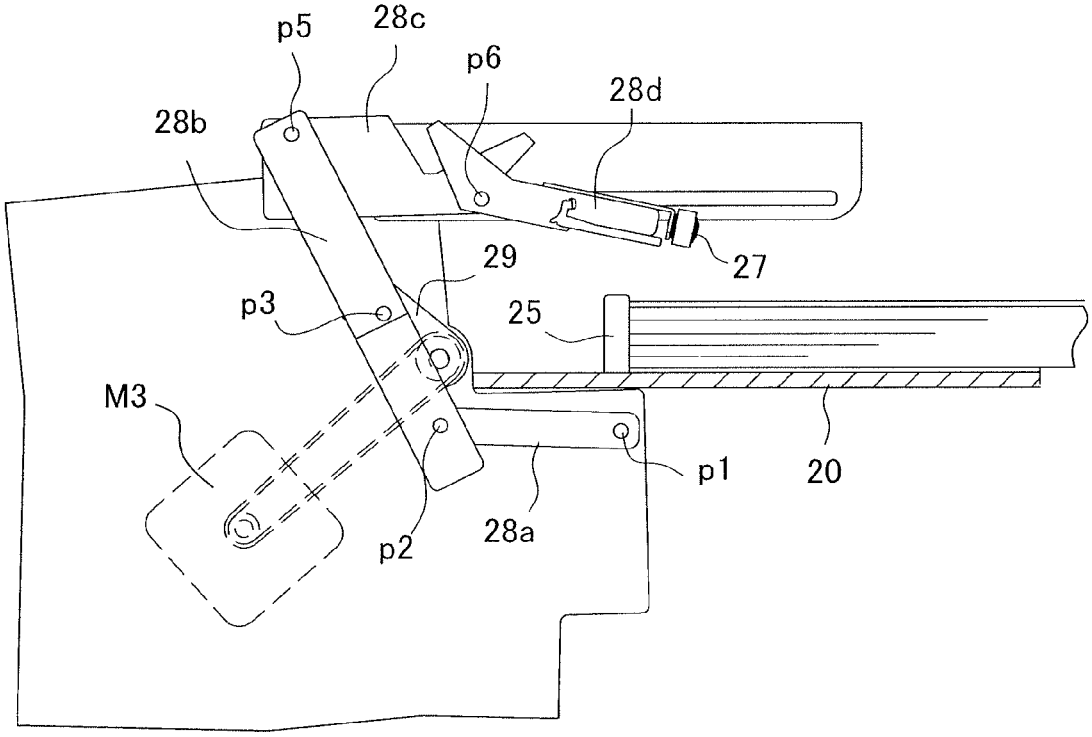
FIG. 9A is a view illustrating a state in which the transport body travel means is retracted from above the sheets.
Figure 9B:
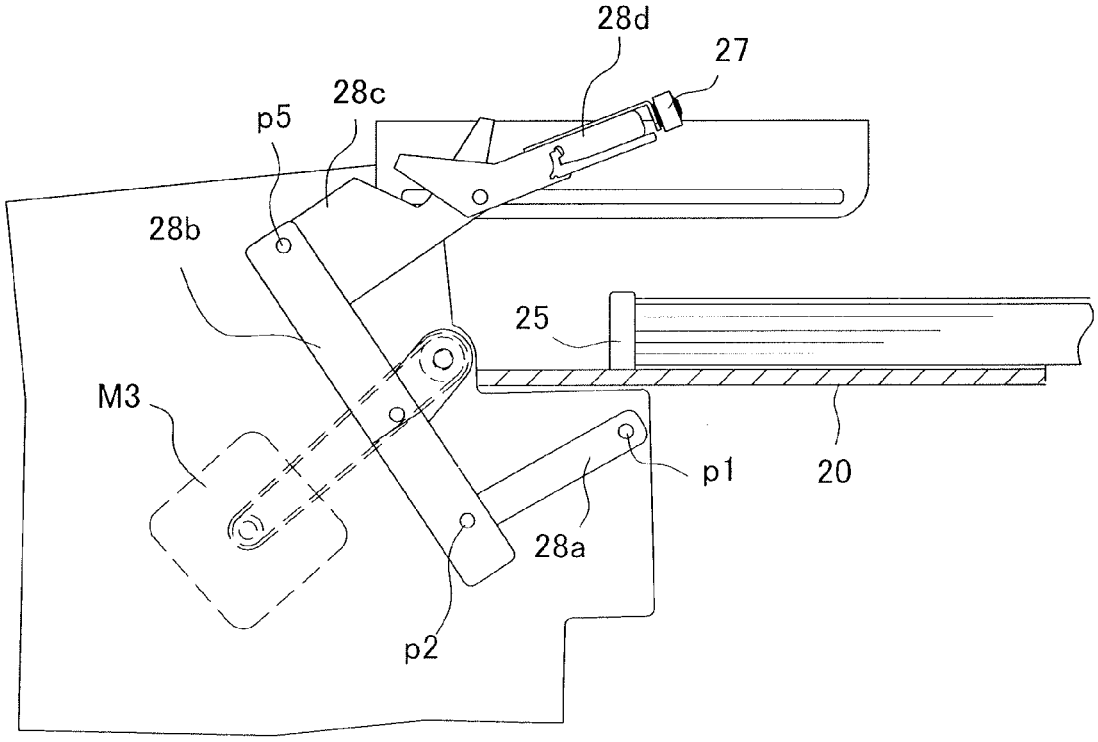
FIG. 9B is another view illustrating the state in which the transport body travel means is retracted from above the sheets.

FIG. 9A shows a state in which the body 27 separates from the sheet top surface after causing the sheet end to strike the regulation stoppers, and the body 27 shifts to the home position in FIG. 7A via FIG. 9B to wait for carry-in of the next sheet. In addition, among the bunch of sheets aligned by the aligning transport means 26, when the last sheet immediately before discharge (a single sheet in the case of aligning only the single sheet to discharge) is aligned, the motor M3 is stopped in the sheet strike position in FIG. 8B, and the side edge support member 20 and the friction transport body 27 nip the bunch of sheets. In this state, the post-processing (staple processing) is performed on the bunch of sheets in the second sheet discharge mode described later. Meanwhile, in the third sheet discharge mode, the side edge support member 20 is retracted with the bunch of sheets nipped by the side edge support member 20 and the friction transport body 27, then the rear end support member 19 is retracted, and the bunch of sheets is discharged onto the paper mount surface 15*a* of the stack tray 15. Then, the aligning transport means 26 shifts to the home position. In shifting the side edge support member 20 to the waiting position, since the friction transport body 27 presses the sheets, even when the area supported by the side edge support member 20 is small, the sheets do not fluctuate to the sheet width direction (the shift direction of the side edge support member 20).

Figure 10A:
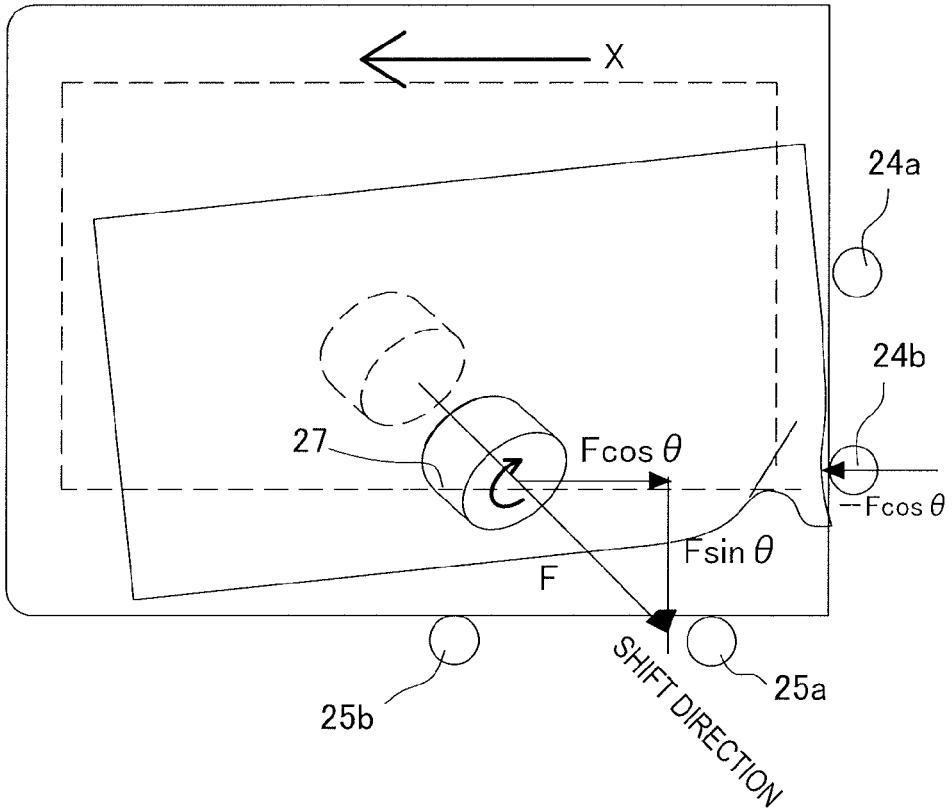
FIG. 10A is an explanatory view illustrating the action of the friction transport body and shows a case of transporting a sheet in a direction (θ=45°) crossing the sheet discharge direction arrow X.
Figure 10B:
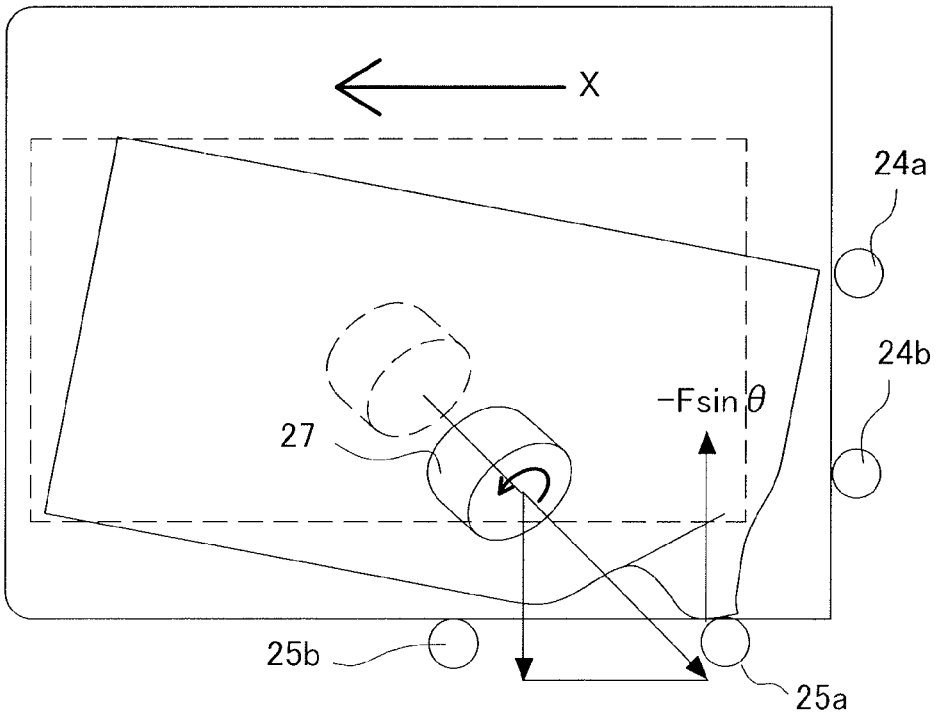
FIG. 10B is another explanatory view illustrating the action of the friction transport body and shows a case where a sheet is transported in a different direction from that in FIG. 10A.

FIGS. 10A and 10B are explanatory views illustrating the action of the friction transport body 27. FIG. 10A shows the case of transporting the sheet in the direction ($\theta$=45 degrees) crossing the sheet discharge direction of the arrow X. Then, when the sheet is shifted from the dashed-line state to the solid-line state shown in the figure, FIG. 10A shows a state in which the sheet rear end edge strikes the rear end regulation stopper 24 first. The transport force F acts on the sheet in the travel direction, the component force (F cos $\theta$) in the X direction acts on the rear end regulation stopper 24, and the component force (F sin $\theta$) in the Y direction acts on the side edge regulation stopper 25 side.

At this point, when the sheet rear end strikes the rear end regulation stopper 24 first as shown in the figure, the reaction force of the X-direction component force (F cos $\theta$) acts on the sheet. Although the sheet buckles and is distorted by the reaction force, the friction transport body 27 rotates in a clockwise direction in the figure. By this rotation, the sheet is prevented from buckling and being distorted due to the reaction force. In addition, by the friction transport body 27 rotating, since the sheet is acted upon by the force in the direction for shifting the sheet to the regulation stopper 25 side, the sheet side edge is struck by the regulation stopper 25 by the friction transport body 27 shifting in the travel direction while rotating after causing the sheet side edge to strike the regulation stopper 24.

Next, FIG. 10B shows the case where the sheet is transported in the different direction from the former direction. FIG. 10B shows a state in which the sheet side edge first strikes the side edge regulation stopper 25 when the sheet is dragged and transported in the direction crossing the sheet discharge direction (the arrow X) shown in the figure. As described previously, the sheet is acted upon by the X-direction component force and the Y-direction component force (F sin $\theta$), the sheet side edge is struck, and the reaction force is conveyed to the sheet. Then, the friction transport body 27 rotates in the counterclockwise direction as shown in the figure, and corrects the posture of the sheet so as to prevent the sheet from buckling and being distorted. In addition, by the friction transport body 27 rotating, since the sheet is acted upon by the force in the direction for shifting the sheet to the regulation stopper 24 side, the sheet rear edge is struck by the regulation stopper 24 by the friction transport body 27 shifting in the travel direction while rotating after causing the sheet side edge to strike the regulation stopper 25. Particularly, when the sheet size is large, the distance by which the friction transport body 27 shifts is long after the sheet side edge is struck by the regulation stopper 25. Accordingly, when the sheet size is large, the rotation amount of the friction transport body 27 is also large, and it is possible to obtain a large force to shift the sheet to the regulation stopper 24 side.

This Embodiment is characterized in that the relationship between the sheet carry means (aligning transport means) 26 and the regulation stoppers 24, 25 is configured as described next. In the sub-tray 18 is disposed the rear end regulation stopper 24 for regulating the sheet rear and the side end regulation stopper 25 for regulating the sheet side end. This is because of positioning the rear end in the processing position in the sheet discharge front and back direction, while positioning one side end in the processing position in the left and right width direction, and thereby positioning in the processing position (binding position). The rear end regulation stopper 24 shown in the figure is comprised of stopper protrusions (hereinafter, referred to as rear end lock protrusions) 24*a* and 24*b* such as implanted pins and height differences that are integrally formed in the apparatus frame 10, and a lock distance Sx is formed between lock protrusions. Similarly, the side end regulation stopper 25 is comprised of side end lock protrusions 25*a* and 25*b*, and a lock distance Sy is formed.

In the rear end lock protrusions 24*a*, 24*b* and side end lock protrusions 25*a*, 25*b*, a post-processing area Ar into which the sheet rear end enters is formed between mutually close protrusion 24*b* and protrusion 25*a*, and the post-processing means 23 is positioned inside the area.

The sheet carry means 26 described previously is disposed between the side end lock protrusions 25*a* and 25*b*, and is comprised of the friction transport body 27 that shifts along a predetermined track while friction-engaging in the sheet top surface on the sub-tray 18.

This Embodiment is characterized by adopting the following configuration in order to position a sheet in a correct position without causing a sheet jam in the sheet when the sheet carry means 26 positions the sheet carried out onto the sub-tray in the predetermined processing position (position regulated by the rear and side end stoppers). The description is given first on a sheet jam phenomenon to solve and next on the configuration to resolve the jam.

[Sheet Jam Phenomenon]

Figure 12A:
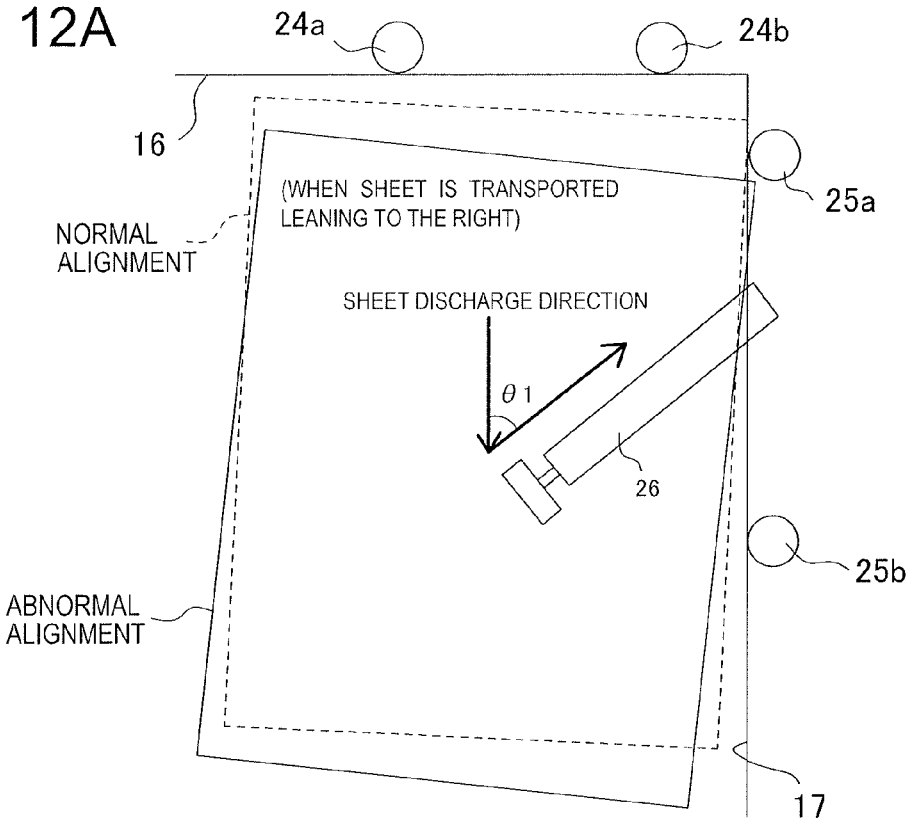
FIG. 12A is an explanatory view of a sheet jam and is a view illustrating a case where the transport force is applied rightward by the sheet transport means.
Figure 12B:
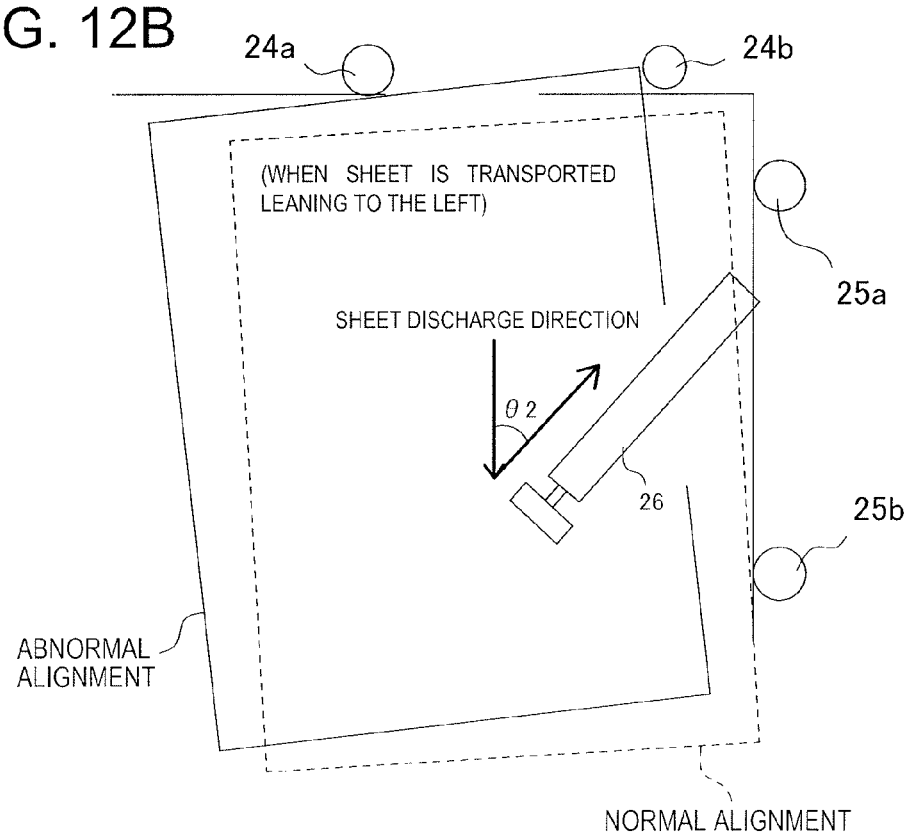
FIG. 12B is an explanatory view of a sheet jam and is a view illustrating a case where the transport force leaning in the left direction is applied.

With reference to FIGS. 12A and 12B, described is a sheet jam when a sheet carried onto the sub-tray 18 is struck and positioned by the rear end regulation stopper 24 and the side end regulation stopper 25. When the transport force is applied to the sheet carried out on the sub-tray rightward in FIG. 12A by the sheet carry means 26, the corner of the sheet enters into the lock distance Sy as shown in the figure, and causes a sheet jam. Further, conversely, as shown in FIG. 12B, when the sheet transport means 26 applies the transport force leaning to the left direction, the corner of the sheet enters into the lock distance Sx of the rear end regulation stopper 24, and causes a sheet jam. Accordingly, it is necessary to set transport conditions for the sheet corner not to enter into the stopper distance on the transport force and direction applied to a sheet by the sheet carry means 26 and side end and rear end regulation stoppers (lock protrusions) 24, 25.

[Configuration to Dissolve the Jam]

This Embodiment is characterized in that in carrying sheets carried onto the sub-tray to a predetermined binding position by the sheet carry means 26, the transport trajectory is to "transport in a transport trajectory for striking one of the rear end and side end stoppers, and then, along this stopper, striking the other stopper". The configuration and action will be described.

Figure 11A:
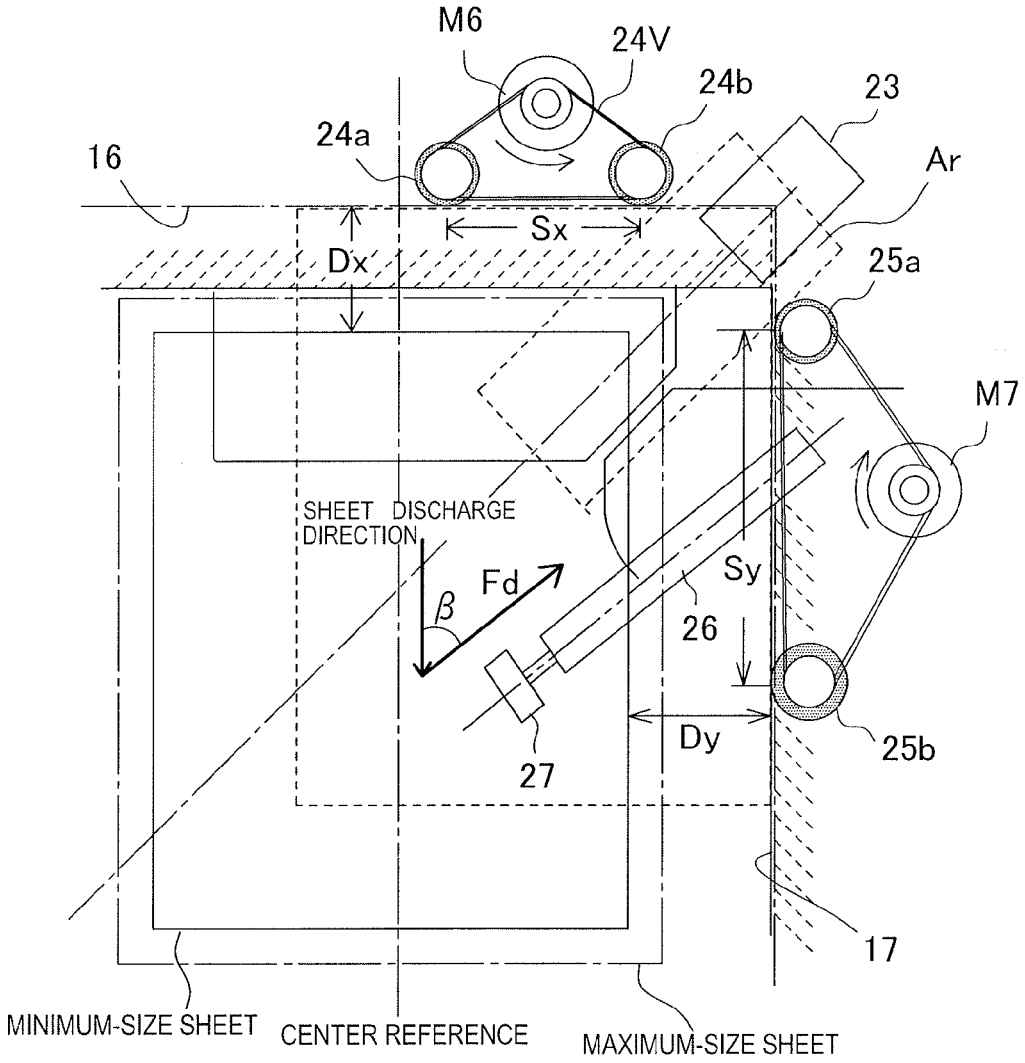
FIG. 11A is a view illustrating the entire configuration of a regulation stopper.
Figure 11B:
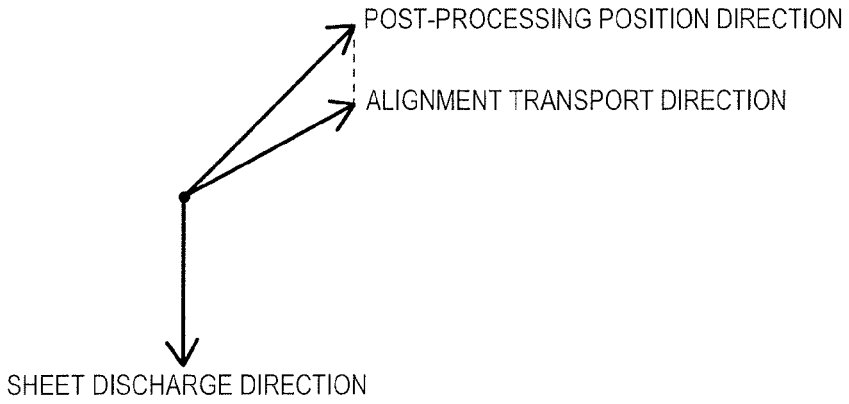
FIG. 11B is an action relationship diagram of the transport force of the regulation stopper.

In the rear end regulation stopper 24, as described previously, the floating rollers 24*a*, 24*b* are supported rotatably by pins fixed to the apparatus frame 10, and are rotating in a counterclockwise direction in FIG. 11A by a feed motor M6. Further, in the side end regulation stopper 25, the floating rollers 25*a*, 25*b* are rotated in a clockwise direction in FIG. 11A by a feed motor M7. Then, the floating rollers 24*a*, 24*b* and floating rollers 25*a*, 25*b* are respectively formed at distances of the lock distance Sx and the lock distance Sy having predetermined spans.

Meanwhile, the sheet carry means 26 is comprised of the friction transport body 27 and travel transport means (manipulator) 28 that shifts the transport body in a predetermined trajectory as described previously. Then, the travel transport means 28 shifts the sheet transported onto the sub-tray to a post-processing position to position in the motion order of FIGS. 7A, 7B, 8A, 8B, 9A and 9B.

At this point, the sheet carry means 26 transports the sheet discharged onto the sub-tray in the center reference so that the sheet side end is first struck by the side end regulation stopper 25 and is locked, and that then, along the regulation stopper 25, the sheet is second transported to a position to strike the rear end regulation stopper 24. In other words, the friction transport body 27 is disposed in the direction such that the transport force Fd applied to the sheet crosses at a predetermined angle (β) with respect to the sheet discharge direction in the figure.

Then, the transport force application direction (angle β) is set at the angle range (θ1>β>θ2) in which the sheet is neither transported leaning to the right as shown in FIG. 12A nor transported leaning to the left as shown in FIG. 12B. In addition, in the conditions, when the angle is set with respect to the sheet of the minimum size carried out onto the sub-tray in the center reference, the same result (without causing a jam sheet) is obtained also in the sheet of the maximum size.

In this Embodiment, described is the case where the sheet carry means 26 is disposed inside the lock distance Sy of the side end regulation stopper 25, and the same effect it obtained when the means 26 is disposed inside the lock distance Sx of the rear end regulation stopper 24. In this case, the transport force application direction of the sheet carry means 26 is set at angles so that the sheet rear end first strikes the rear end regulation stopper 24, and that the side end then strikes the side end regulation stopper 25.

FIGS. 10A and 10B are explanatory views illustrating the action of the friction transport body 27. FIG. 10A shows the case of transporting the sheet in the direction (θ=45 degrees) crossing the sheet discharge direction of the arrow X. Then, when the sheet is shifted from the dashed-line state to the solid-line state shown in the figure, FIG. 10A shows a state in which the sheet rear end edge strikes the rear end regulation stopper 24 first. The transport force F acts on the sheet in the travel direction, the component force (F cos θ) in the X direction acts on the rear end regulation stopper 24, and the component force (F sin θ) in the Y direction acts on the side edge regulation stopper 25 side.

At this point, when the sheet rear end strikes the rear end regulation stopper 24 first as shown in the figure, the reaction force of the X-direction component force (F cos θ) acts on the sheet. Although the sheet buckles and is distorted by the reaction force, the friction transport body 27 rotates in a clockwise direction in the figure. By this rotation, the sheet is prevented from buckling and being distorted due to the reaction force. In addition, by the friction transport body 27 rotating, since the sheet is acted upon by the force in the direction for shifting the sheet to the side end regulation stopper 25 side, the sheet side edge is struck by the regulation stopper 25 by the friction transport body 27 shifting in the travel direction while rotating after causing the sheet side edge to strike the regulation stopper 24.

Next, FIG. 10B shows the case where the sheet is transported in the different direction from the former direction. FIG. 10B shows a state in which the sheet side edge first strikes the side edge regulation stopper 25 when the sheet is dragged and transported in the direction crossing the sheet discharge direction (the arrow X) shown in the figure.

As described previously, the sheet is acted upon by the X-direction component force and the Y-direction component force (F sin θ), the sheet side edge is struck, and the reaction force is conveyed to the sheet. Then, the friction transport body 27 rotates in the counterclockwise direction as shown in the figure, and corrects the posture of the sheet so as to prevent the sheet from buckling and being distorted. In addition, by the friction transport body 27 rotating, since the sheet is acted upon by the force in the direction for shifting the sheet to the regulation stopper 24 side, the sheet rear edge is struck by the regulation stopper 24 by the friction transport body 27 shifting in the travel direction while rotating after causing the sheet side edge to strike the regulation stopper 25. Particularly, when the sheet size is large, the distance by which the friction transport body 27 shifts is long after the sheet side edge is struck by the regulation stopper 25. Accordingly, when the sheet size is large, the rotation amount of the friction transport body 27 is also large, and it is possible to obtain a large force to shift the sheet to the regulation stopper 24 side.

[Different Embodiment of the Aligning Transport Means]

The Embodiment (referred to as Embodiment 1) is described in which the friction transport body 27 as described above is comprised of a roll body (floating roller 27*r*) rotating in the direction orthogonal to the direction for shifting the sheet. As well as the Embodiment, FIG. 13A shows Embodiment 2 and FIG. 13B shows Embodiment 3 as Embodiments different from FIG. 6 in which friction drag of the friction transport body 27 is set to be large in the travel direction, while being set to be small in the travel orthogonal direction.

Figure 13A:
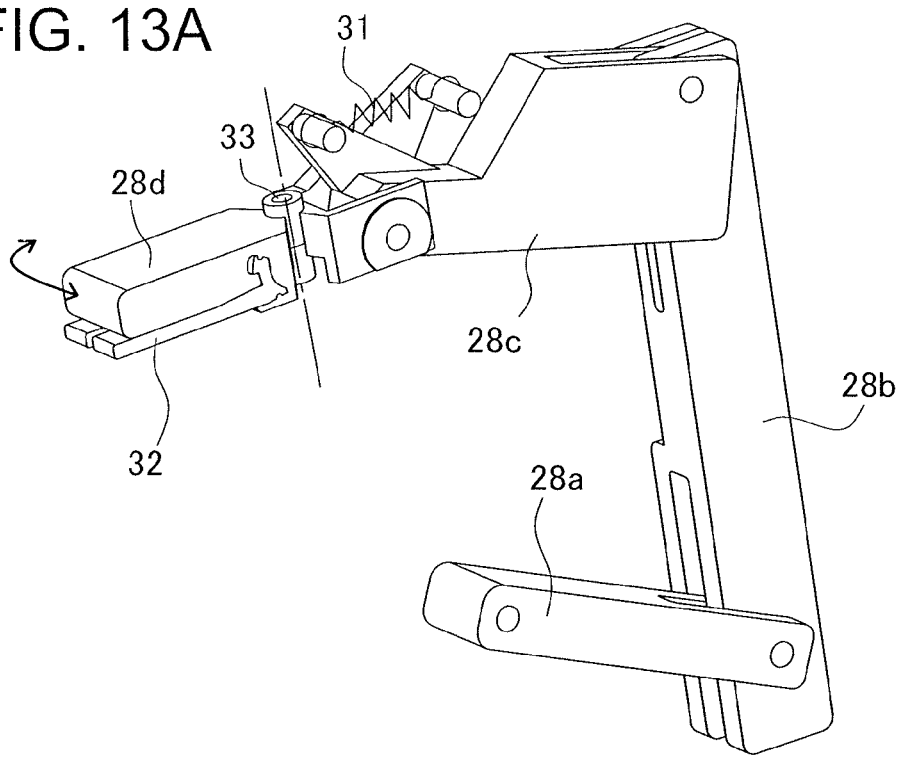
FIG. 13A is a view illustrating a friction transport body (revolving mechanism) of Embodiment 2 in the post-processing apparatus of FIG. 2.
Figure 13B:
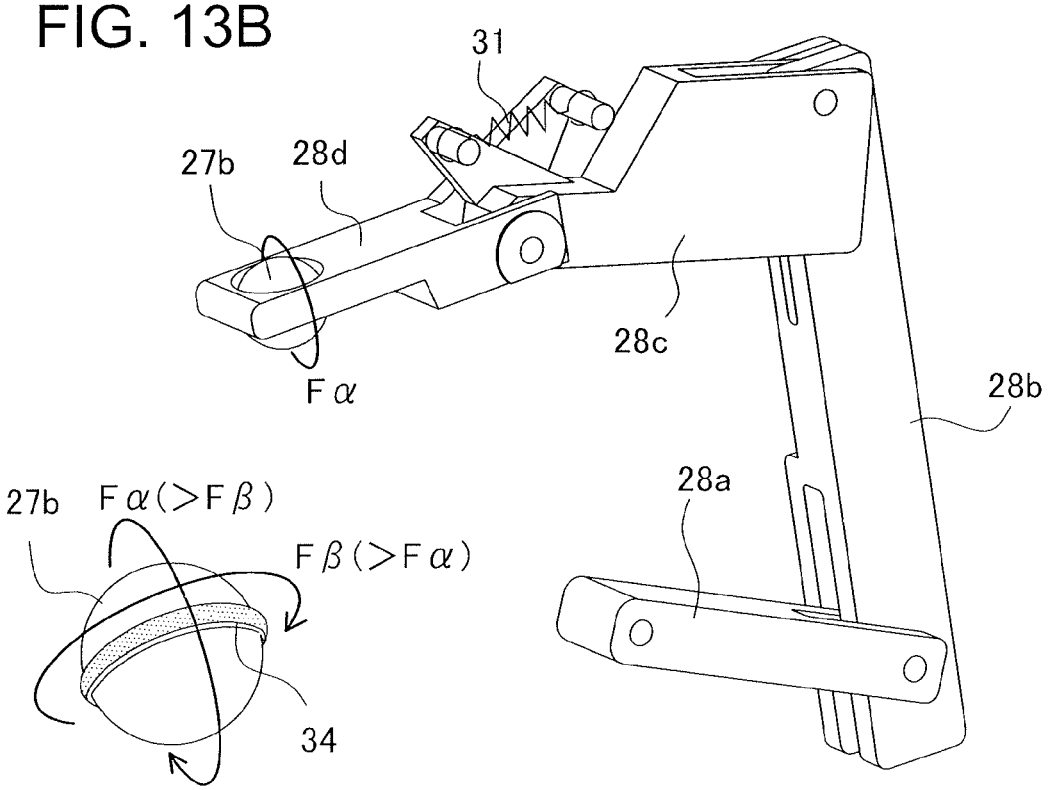
FIG. 13B is a view illustrating a friction transport body (ball body and braking mechanism) of Embodiment 3 in the post-processing apparatus of FIG. 2.

In Embodiment 2, as shown in FIG. 13A, the friction transport body 27 is comprised of a pad member 32 that comes into surface contact with a sheet, and a hold member 28*d* (in the apparatus shown in the figure, actuation arm) that supports the transport body 27 is bearing-supported by a shaft pin 33 to be able to be changeable in position (rotatable) in the travel orthogonal direction. By this means, when one side of a sheet strikes the regulation stoppers 24, 25 and the buckling force acts, the friction transport body 27 rotates on the bearing shaft in the action direction (drag direction of the stopper) together with the hold member 28*d*.

In addition, in Embodiment 2, the hold member that supports the friction transport body 27 is not limited to the actuation arm that directly supports the friction transport body as shown in the figure, and may be the third arm 28*c* to support (mount) the actuation arm or other arm member. In other words, it is possible to adopt various configurations as long as the configurations are of the mechanism for causing the mount member that supports the friction transport body 27 on the apparatus frame 10 to perform free movement in the travel orthogonal direction. In the above-mentioned description, described is the Embodiment in which the mount member that supports the friction transport body is to reduce friction drag in the transport orthogonal direction, and the other components in FIG. 13A are the same as those shown in FIG. 6 and are assigned the same reference numerals to omit descriptions thereof.

By thus configuring, when the friction transport body travels and shifts in the sheet-discharge orthogonal direction, one side of the sheet first strikes the side edge regulation stopper 25 or rear end regulation stopper 24, and when the buckling deformation force for curving the sheet occurs, the action force acts on the friction transport body 27 as friction drag in the travel orthogonal direction. At this point, since the friction transport body 27 is supported by the bearing pin to be rotatable in the travel orthogonal direction, the body 27 performs revolving motion with the pin as the center. As a result, friction drag of the friction transport body is lower in the travel orthogonal direction than in the transport direction.

FIG. 13B shows Embodiment 3 of the friction transport body 27. In the body shown in the figure, the friction transport body 27 is comprised of a ball body (sphere). In other words, a ball body 27*b* made of a rubber material, resin material or the like is supported at the front end of the actuation arm 28*d* to be able to perform rolling motion. Then, as shown in FIG. 13B, on the ball body 27*b*, a brake shoe 34 such that friction resistance acts highly in the travel direction is disposed as a braking mechanism so as to decrease friction resistance in the travel orthogonal direction. By this means, the ball body 27*b* is limited in rolling motion in the travel direction while performing rolling motion freely in the travel orthogonal direction, and exhibits the same action as in the roll structure in Embodiment 1 as described previously.

In addition, in the present invention, the friction transport body 27 is not limited to roll rolling motion (Embodiment 1), holder rotation (Embodiment 2) and ball rolling motion (Embodiment 3), and it is also possible to make coefficients of friction of the friction transport body 17 different between the travel direction and the travel orthogonal direction. For example, the friction transport body is comprised of a friction pad in the shape of a plate, semi-cylinder or the like. Then, surface treatment is applied so that the coefficient of friction of the pad surface is large in the travel direction while being small in the travel orthogonal direction. As the processing method, for example, such a method is known that wrinkles having the directivity are formed on the surface of the rubber material to make anisotropic coefficients of friction.

[Configuration of the Sheet Regulation Means]

As described above, the rear end regulation stopper 24 and side end regulation stopper 25 are disposed in the apparatus frame 10, and a sheet carried onto the sub-tray 18 strikes the stoppers, and is positioned in a post-processing position. At least one of the rear end regulation stopper 24 and side end regulation stopper 25 is required to be disposed, and in the apparatus shown in the figure, the regulation stoppers 24, 25 are respectively disposed at the rear end and side end. The regulation stoppers will be described according to FIG. 14A. In the rear end regulation stopper 24, as described previously, the floating rollers 24*a*, 24*b* are supported rotatably by pins fixed to the apparatus frame 10, and are rotating in a counter-clockwise direction in FIG. 14A by the feed motor M6. Further, in the side end regulation stopper 25, the floating rollers 25*a*, 25*b* are rotated in a clockwise direction in FIG. 14A by the feed motor M7. Then, the floating rollers 24*a*, 24*b* and floating rollers 25*a*, 25*b* are respectively formed at distances of the lock distance Sx and the lock distance Sy having predetermined spans.

Meanwhile, the sheet carry means (aligning transport means) 26 is comprised of the friction transport body 27 as described previously, travel transport means (manipulator) 28 that shifts the transport body in a predetermined trajectory, and travel guide means 32 (in the apparatus shown in the figure, unit frame that supports the manipulator) that guides motion of the travel transport means 28. Then, the travel transport means 28 shifts the sheet transported onto the sub-tray 18 to a post-processing position to position in the motion order of FIGS. 7A, 7B, 8A, 8B, 9A and 9B.

At this point, the sheet carry means 26 transports the sheet discharged onto the sub-tray 18 in the center reference so that first "the sheet side end is struck by the side end regulation stopper 25 and is locked", and that then, "along the regulation stopper 25, the sheet is transported to a position in which the sheet strikes the rear end regulation stopper 24". In other words, the friction transport body 27 is disposed so as to apply the transport force Fd in the direction crossing the sheet discharge direction at a predetermined angle (β) in the figure. Accordingly, the travel transport means 28 having the friction transport member 27 and the travel guide means 32 that guides the motion are also disposed between a pair of regulation stoppers 25*a*, 25*b* in the direction crossing the sheet discharge direction at the angle β.

In such a configuration, the sheet carried onto the sub-tray 18 from the sheet discharge outlet 13 enters into between the travel transport means 28 retracted to above the sub-tray (side end support member) 20 and the uppermost sheet on the tray. At this point, when the discharged sheet is curled upward, the sheet strikes the travel transport means 28 or travel guide means 32, and a sheet jam is invited or sheet folding occurs.

[Configuration of the Sheet Guide Means]

Therefore, in this Embodiment, in order to prevent a sheet from being curved and deformed in carrying the sheet carried onto the sub-tray 18 toward the regulation stopper (side edge regulation stopper), the following sheet guide means SG (first guide member 41, second guide member 32*a*) is provided.

[First Guide Member]

Figure 16A:
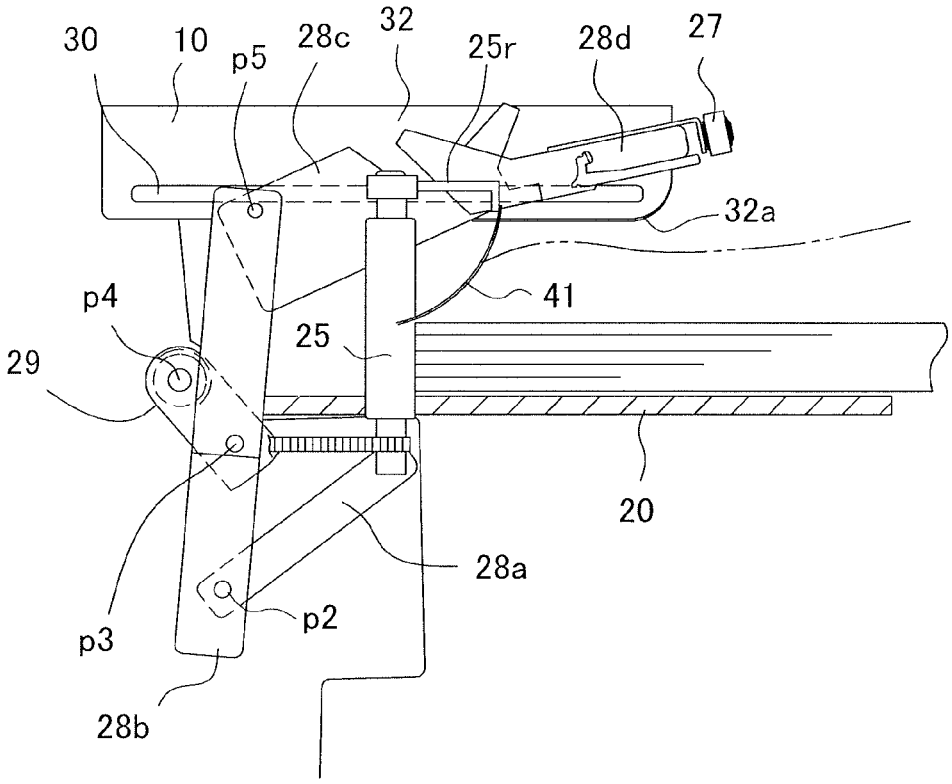
FIG. 16A is an explanatory view of an operation state in the sheet guide mechanism of FIG. 15 and is a view illustrating a sheet guide state in carrying the sheet in the sub-tray.

In order to prevent the sheet from causing warp deformation or curve deformation by the sheet end edge striking the stopper member in carrying the sheet fed from the sheet discharge outlet 13 onto the sub-tray (side end support member 20; the same in the following description) 18 toward the side end regulation stopper 25 by the sheet carry means 28 described previously, first guide members 41*a*, 41*b* are disposed near the side end regulation stopper 25. As shown in FIG. 16A, the first guide members 41*a*, 41*b* are spaced a distance apart within the lock distance Sy. Then, the first guide member 41 shown in the figure is made of a resin film rich in flexibility, while being comprised of a curved piece inclined so as to lower gradually from the center portion to the side edge portion of the support member 20.

Figure 16B:
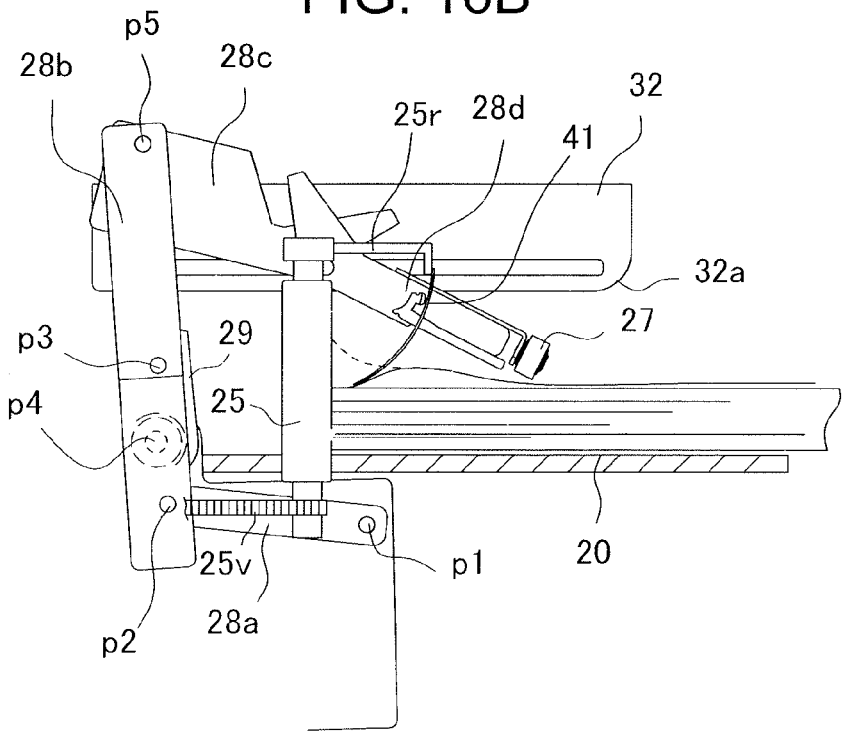
FIG. 16B is an explanatory view of another operation state in the sheet guide mechanism of FIG. 15 and is view illustrating a state in which the sheet carried into the sub-tray is carried toward the stopper means by sheet carry means.
Figure 17A:
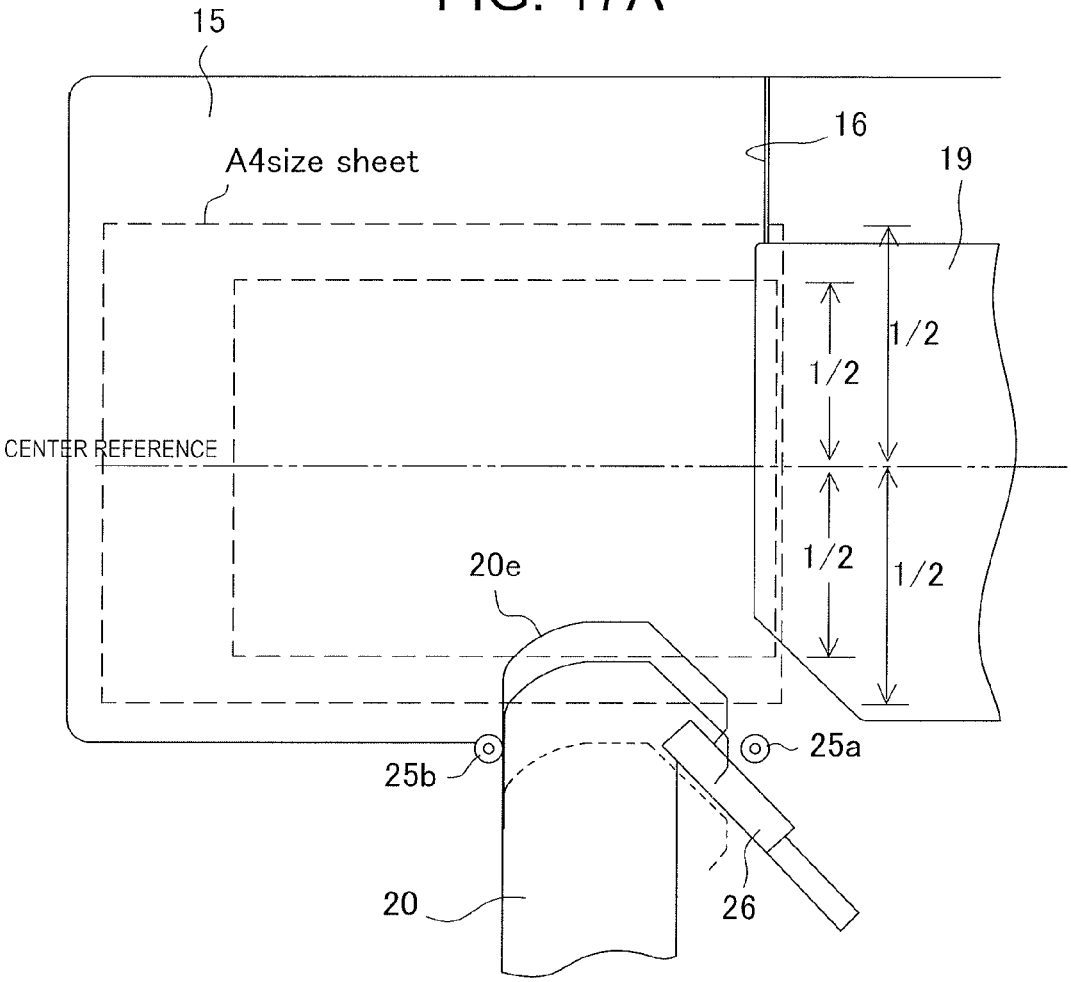
FIG. 17A is an explanatory view illustrating a regulation state of the sheet side edge in directly carrying out the sheet from the sheet discharge outlet to the stack tray (first and third sheet discharge modes), and is an explanatory view of a state of carrying out the sheet from the sheet discharge outlet to the paper mount surface.
Figure 17B:
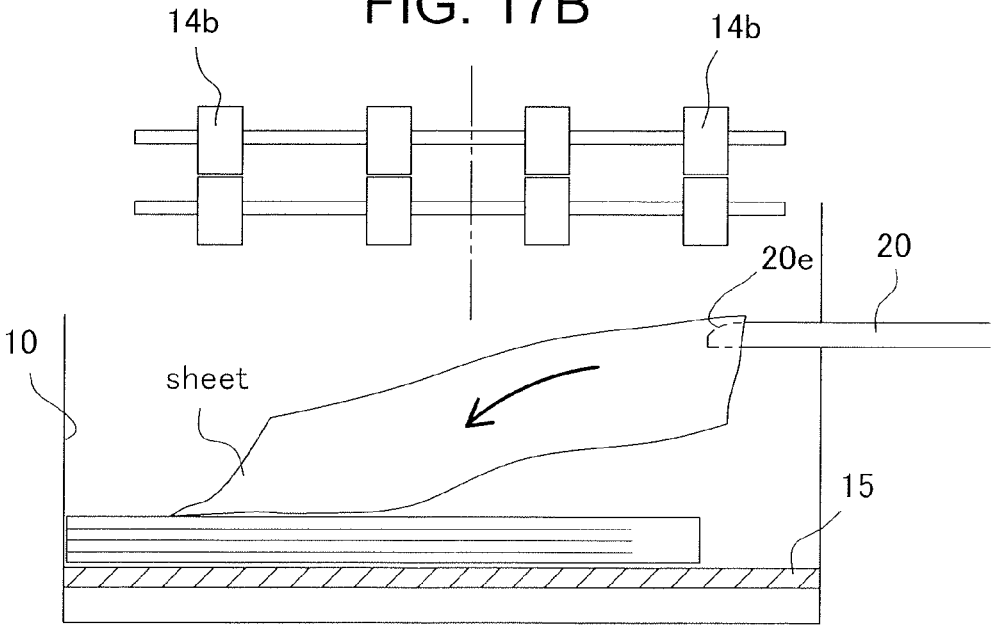
FIG. 17B is another explanatory view illustrating the regulation state of the sheet side edge in directly carrying out the sheet from the sheet discharge outlet to the stack tray (first and third sheet discharge modes) and is an explanatory view of a state in which sheets are collected in a stacked shape on the paper mount surface.

As show in FIG. 16B, the floating rollers 25*a*, 25*b* are rotatably fitted into stopper pins fixed to the apparatus frame 10, and brackets 25*r* are fixed to the stopper pins. Then, the floating rollers 25*a*, 25*b* constitute the side end regulation stopper 25, and the first guide members 41*a*, 41*b* are fixed to the brackets 25*r*.

The first guide members 41*a*, 41*b* are disposed so as to hang over the sheet surface in the shape of landing steps from above the side end support member 20 to below. Then, the member is formed in the curved shape shown in the figure so as to incline gradually in the sheet shift direction, and guides the sheet carried out to the center position of the support member toward the stopper member (regulation stopper) 25 at the side end portion.

By the first guide members 41, in the sheet drawn toward the side end regulation stopper 25 by the sheet carry means 28, even when the sheet warps upward, the sheet is guided to the stopper side along the guide surface. Further, the sheet is prevented from being curved and deformed after striking the regulation stopper.

[Second Guide Member]

The second guide member 32*a* is disposed between the pair of first guide members (within the lock distance). The second guide member 32*a* is formed in the travel guide means 32 (apparatus frame) constituting the sheet carry means described previously.

Figure 14A:
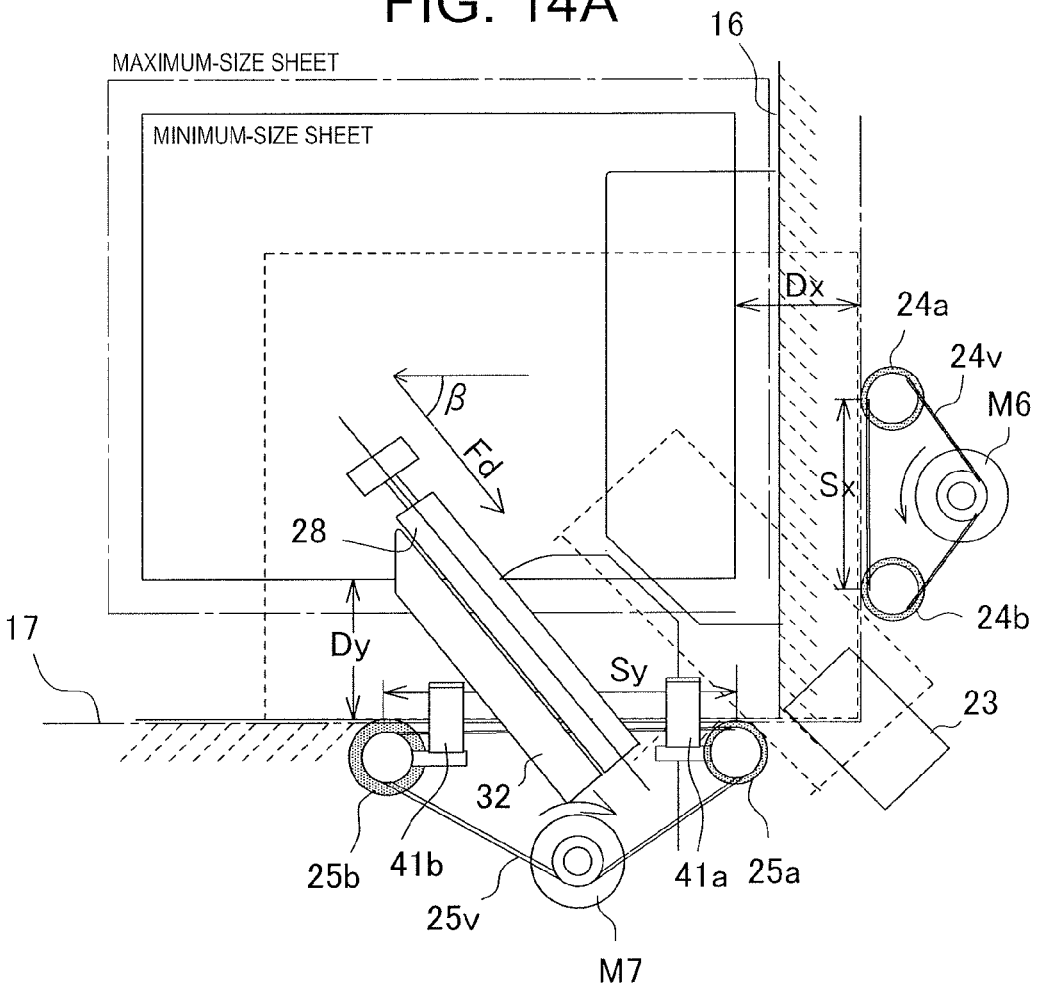
FIG. 14A is an explanatory view of a guide sheet guide mechanism for carrying a sheet that is carried into the sub-tray to the sheet regulation stopper and is a view illustrating a plan configuration.
Figure 14B:
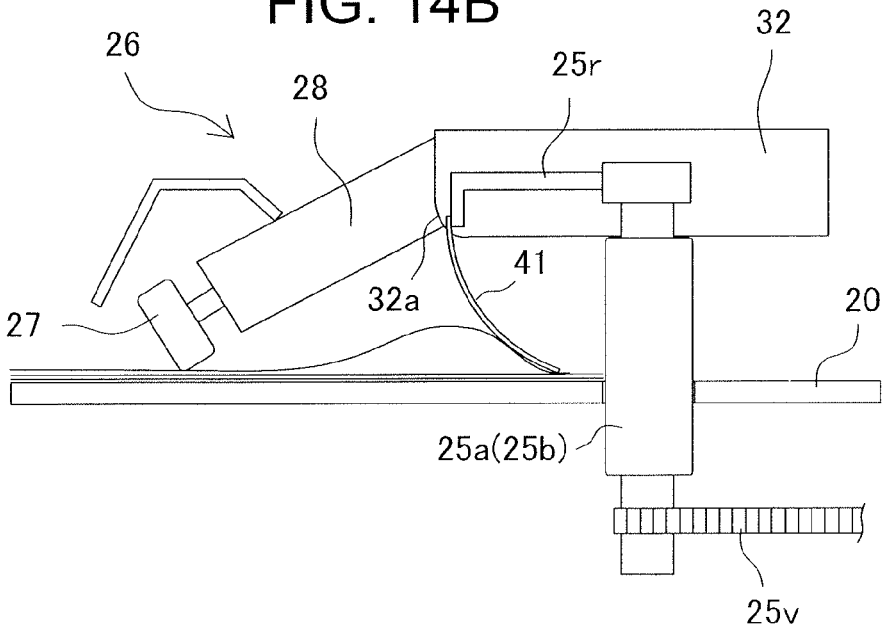
FIG. 14B is another explanatory view of the guide sheet guide mechanism for carrying a sheet that is carried into the sub-tray to the sheet regulation stopper and is a view illustrating a side configuration.

In other words, as shown in FIG. 14A, a pair of first guide members are spaced a distance apart while drooping in the shape of landing steps above the sub-tray (side end support member), and the second guide member 32 is disposed between both guide members to cross.

Figure 15:
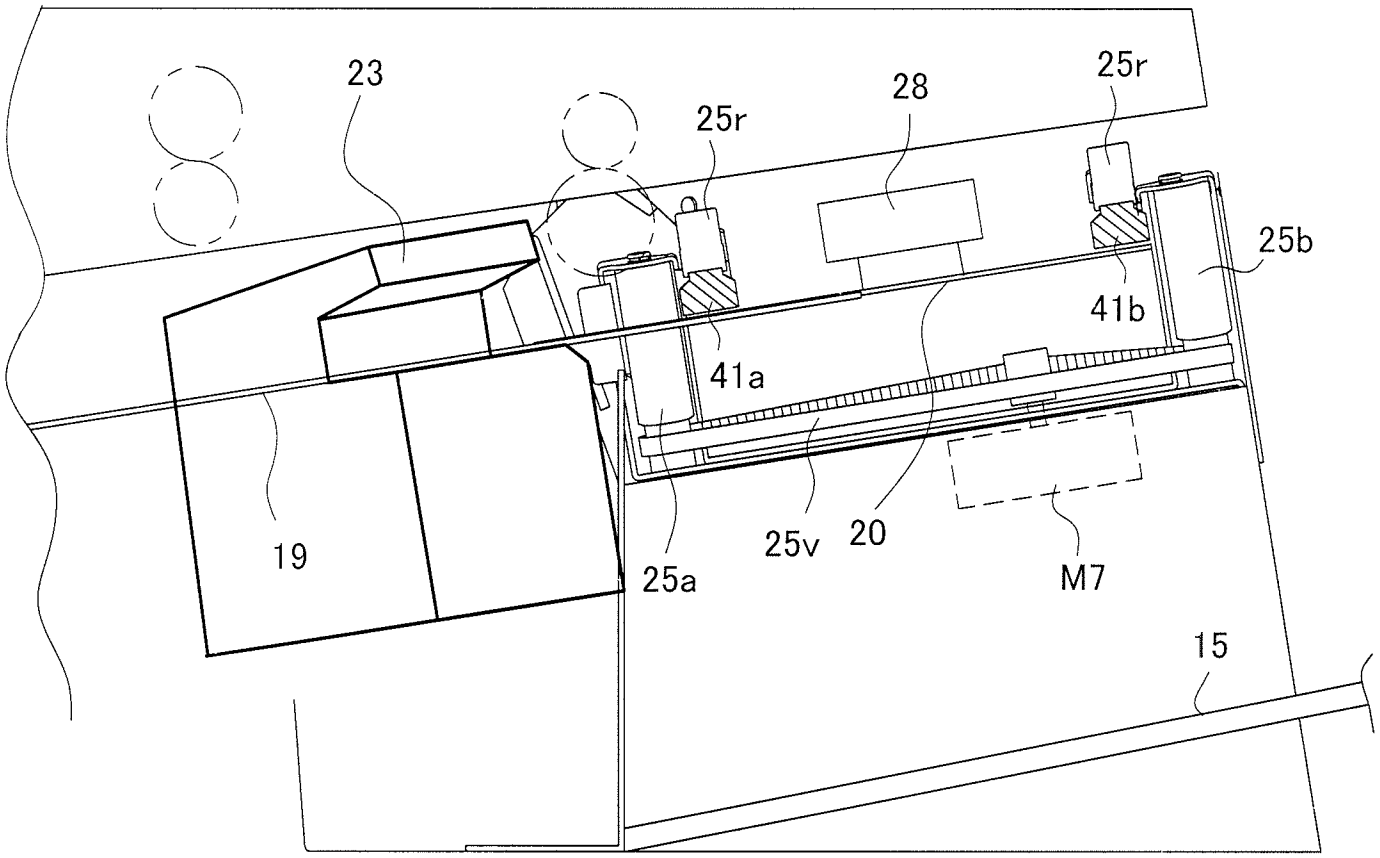
FIG. 15 is a configuration explanatory view of the entire apparatus in the sheet guide mechanism in FIGS. 14A and 14B.

As shown in FIG. 15, the second guide member 32 is disposed to regulate the height position of the sheet in order for the sheet fed from the sheet discharge outlet 13 not to rise above the sub-tray, and to guide the sheet front end to the first guide members 41. Accordingly, the height positions are set so that the second guide member 32*a* guides the sheet to the first guide members 41, and that the first guide members 41 guide the sheet to the regulation stopper 25.

FIGS. 10A and 10B are explanatory views illustrating the action of the friction transport body 27. FIG. 10A shows the case of transporting the sheet in the direction (θ=45 degrees) crossing the sheet discharge direction of the arrow X. Then, when the sheet is shifted from the dashed-line state to the solid-line state shown in the figure, FIG. 10A shows a state in which the sheet rear end edge strikes the rear end regulation stopper 24 first. The transport force F acts on the sheet in the travel direction, the component force (F cos θ) in the X direction acts on the rear end regulation stopper 24, and the component force (F sin θ) in the Y direction acts on the side edge regulation stopper 25 side.

At this point, when the sheet rear end strikes the rear end regulation stopper 24 first as shown in the figure, the reaction force of the X-direction component force (F cos θ) acts on the sheet. Although the sheet buckles and is distorted by the reaction force, the friction transport body 27 rotates in a clockwise direction in the figure. By this rotation, the sheet is prevented from buckling and being distorted due to the reaction force. In addition, by the friction transport body 27 rotating, since the sheet is acted upon by the force in the direction for shifting the sheet to the side end regulation stopper 25 side, the sheet side edge is struck by the regulation stopper 25 by the friction transport body 27 shifting in the travel direction while rotating after causing the sheet side edge to strike the regulation stopper 24.

Next, FIG. 10B shows the case where the sheet is transported in the different direction from the former direction. FIG. 10B shows a state in which the sheet side edge first strikes the side edge regulation stopper 25 when the sheet is dragged and transported in the direction crossing the sheet discharge direction (the arrow X) shown in the figure. As described previously, the sheet is acted upon by the X-direction component force and the Y-direction component force (F sin θ), the sheet side edge is struck, and the reaction force is conveyed to the sheet. Then, the friction transport body 27 rotates in the counterclockwise direction as shown in the figure, and corrects the posture of the sheet so as to prevent the sheet from buckling and being distorted. In addition, by the friction transport body 27 rotating, since the sheet is acted upon by the force in the direction for shifting the sheet to the regulation stopper 24 side, the sheet rear edge is struck by the regulation stopper 24 by the friction transport body 27 shifting in the travel direction while rotating after causing the sheet side edge to strike the regulation stopper 25. Particularly, when the sheet size is large, the distance by which the friction transport body 27 shifts is long after the sheet side edge is struck by the regulation stopper 25. Accordingly, when the sheet size is large, the rotation amount of the friction transport body 27 is also large, and it is possible to obtain a large force to shift the sheet to the regulation stopper 24 side.

[Sheet Alignment Mechanism in the First Support Member (Rear End Support Member)]

The first support member (rear end support member) 19 as described previously is provided with a support surface to mount and support the rear end portion of the sheet fed from the sheet discharge outlet 13, a paddle mechanism 35 that presses and holds the rear end portion of the sheet, and a push-out mechanism for pushing a bunch of collected sheets toward the tray. Each component will be described below.

[Paddle Mechanism]

Figure 4B:
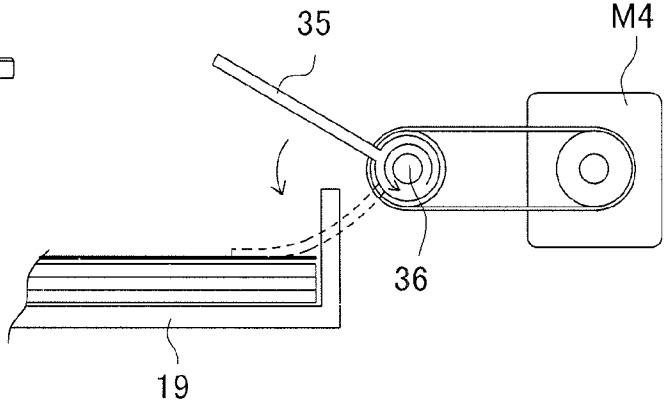
FIG. 4B is an explanatory view of a paddle of the post-processing apparatus in the system of FIG. 1.

The first support member (rear end support member) 19 is disposed with a height difference formed from the sheet discharge roller 14*b*, and the sheet separated from the roller is supported on the support member 20 in a free state. Then, when the subsequent sheet is fed out of the sheet discharge rollers 14*b*, the sheet front end may cause positional displacement of the sheet that is previously mounted. Therefore, required is a means for pressing the rear end portion of the sheet mounted on the first support member 19 to hold. In the apparatus as shown in the figure, as shown in FIG. 4B, paddle members 35 are disposed above the first support member 19.

As shown in the figure, a plurality of paddle members 35 is attached to a rotating shaft 36 to the left and right in the sheet width direction while being spaced a distance apart. The front end of each of the paddle members 35 is comprised of an elastic member in the length shape for pressing and holding the sheet rear end portion on the support member 20, and the member rotates on the rotating shaft 36. Then, the rotating shaft 36 is coupled to a paddle motor M4, a flag (not shown) for angle detection is provided in any one of transmission rotating shafts, and a position sensor Ps4 is disposed on the apparatus frame 10 side. In addition, an encoder and encoder sensor may be configured as a substitute for the flag.

Then, a control means 50 described later rotates the paddle members 35 in the state of pressing the rear end portion of the preceding sheet to retract from the rear end portion of the sheet, before (before execution of) alignment operation for causing the sheet rear end portion carried out of the sheet discharge outlet 13 to be struck against the rear end regulation stopper 24 by the aligning transport means (sheet carry means) 26 as described previously. Then, the means 50 halts the paddle motor M4 at timing at which the paddle members 35 press the sheet top surface after the finish of alignment operation for causing the sheet to be struck against the rear end regulation stopper 24 by the aligning transport means 26.

[Push-out Mechanism]

In the first support member (rear end support member) 19 as described previously are disposed the rear end regulation stopper 24 to position the sheet in a predetermined processing position, and the aligning transport means (sheet carry means) 26 as described previously to shift the sheet toward the stopper. Then, the sheets collected in the shape of a bunch on the support member 19 undergo post-processing by the binding processing apparatus or the like, and then, are carried out toward the stack tray 15. Therefore, a pusher means 37 to push the bunch of sheets subjected to the post-processing toward the stack tray 15 is disposed in the first support member 19.

FIGS. 5A and 5B show the pusher means 37. The pusher means 37 is comprised of a slide member (sheet press member) 38 supported by the first support member (rear end support member) 19 to be slidable, a bent piece 39 provided at the front end of the slide member 38, and a rear end contact surface (paper press surface) 39*s* formed in the bent piece. The rear end contact surface 39*s* engages in the sheet rear end supported on the side end support member.

The slide member (sheet press member) 38 shown in the figure is fitted into a guide groove 40 formed in the first support member (rear end support member) 19, and is configured so that the rear end contact surface (paper press surface) shifts back and forth by a predetermined distance in the sheet discharge direction. A rack 38*r* is attached to the base end portion of the slide member 38, a pinion 38*p* engaging therein is attached to the apparatus frame 10, and a pusher motor M5 is coupled to the pinion 38*p*. Then, in mounting and supporting sheets fed from the sheet discharge outlet 13 on the support member 19, the control means 50 described later causes the rear end contact surface 39*s* to wait in a position retracted from the rear end regulation stopper 24, and starts the pusher motor M5 with a job end signal of the post-processing. Then, the slide member 38 shifts in the direction of the stack tray 15 from the waiting position in the sheet discharge direction. At this point, the rear end contact surface engages in the rear end of the bunch of sheets, and pushes the bunch toward the stack tray 15. In addition, the rack 38*r*, pinion 38*p* and pusher motor M5 constitute a push shift means 39.

Then, when the rear end contact surface (paper press surface) 39*s* shifts to a predetermined position, the control means 50 halts the pusher motor M5, and next, shifts the support member 19 from the actuation position Ap above the stack tray 15 to the waiting position (retract position) Wp retracted to outside the stack tray 15. By this operation, the bunch of sheets is dropped on the paper mount surface 15*a* of the stack tray 15 and is stored.

In addition, in the first sheet discharge mode described later, the apparatus as shown in the figure uses the rear end support member 19 as an assist means for carrying out the sheet to the paper mount surface 15*a* from the sheet discharge outlet 13 in cooperation with the sheet discharge rollers 14*b*. Therefore, as shown in FIG. 3B, in the rear end support member 19 described previously is formed a sheet engagement surface 19*s* that engages in the lower surface of the sheet traveling toward the paper mount surface 15*a* from the sheet discharge outlet 13.

Figure 3B:
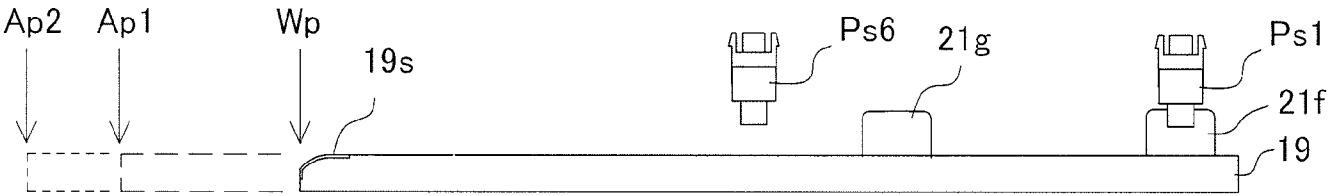
FIG. 3B is an explanatory view of operation of a rear end support member in the post-processing apparatus in the system of FIG. 1.

As shown in FIG. 3B, in the plate-shaped first support member 19, the sheet engagement surface 19*s* is provided at its front end portion (part protruding to the paper mount surface 15*a*), and in the member shown in the figure, the support member itself of a synthetic resin, metal or the like constitutes the sheet engagement surface 19*s*. Moreover, as the sheet engagement surface 19*s*, a soft pad with relatively high friction such as a resin, rubber material and cork may be embedded in the support member surface. In any configuration, it is preferable that the sheet engagement surface 19*s* is provided with a coefficient of friction to shift the sheet in the sheet discharge direction and softness of the extent to which the sheet lower surface does not sustain damage.

In addition, the height difference between the paper press surface 38*s* and the rear end regulation surface 16 in the actuation position of the sheet push member 38 is capable of being set at a different distance position corresponding to the material, size, weighing or the like of the sheet S. Accordingly, the control means 50 is capable of changing the rotation amount of the pusher motor M5 constituting the pusher shift means 39 corresponding to the property of the sheet fed from the sheet discharge outlet 13.

Further, when the sheet fed from the sheet discharge outlet 13 is a thinner sheet or weaker than a normal sheet as a reference and is of property easy to become distorted from the input information from an input means (touch panel type of liquid crystal screen or the like provided in the image formation apparatus A), it is desirable that the control means 50 sets the actuation position at a distance position such that the height difference is formed to be larger (sets the height difference in the sheet discharge direction to be larger in a sheet easy to become distorted while setting the height different to be smaller in a strong sheet).

Furthermore, it is possible to set the height difference between the paper press surface 38*s* and the rear end regulation surface 16 in the actuation position of the sheet push member 38 at a different distance position corresponding to the load amount of sheets loaded on the paper mount surface 15*a*. At this point, the control means 50 changes the rotation amount of the pusher motor M5 constituting the pusher shift means 39 with a signal from a load amount identifying means (number-of-sheet counter, weight sensor, height sensor or the like) that identifies the load amount of sheets S loaded on the paper mount surface 15*a*.

[Description of Control Configuration]

Figure 18:
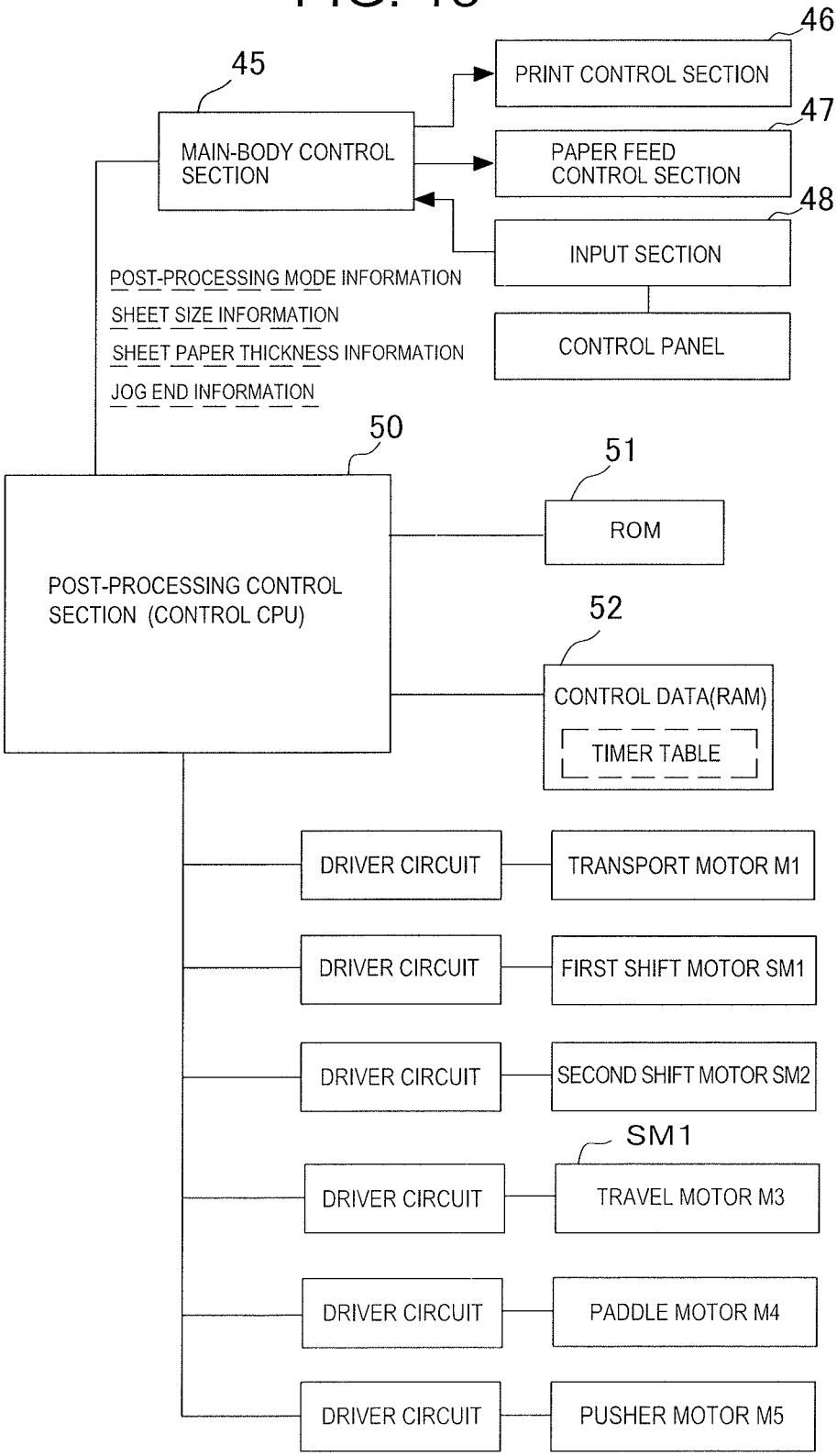
FIG. 18 is an explanatory view (block diagram) of a control configuration in the system of FIG. 1.

The control configuration of the image formation system will be described according to the block diagram of FIG. 18. The image formation system as shown in FIG. 1 is provided with a control section 45 (hereinafter, referred to as a "main-body control section") of the image formation apparatus A, and the control section 50 (hereinafter, referred to as a "post-processing control section") of the sheet post-processing apparatus B. The main-body control section 45 is provided with a print control section 46, paper feed control section 47 and input section 48 (control panel).

Then, the setting of an "image formation mode" and "post-processing mode" is performed from the input section (control panel). The image formation mode is to set modes such as color/monochrome print and two-side/one-side print, and to set image formation conditions such as the sheet size, sheet paper property, number-of-print out copies and reduction/enlargement print. For example, the "post-processing mode" is set at "print out mode", "staple finish mode (staple binding processing mode)", "jog sort mode" and the like.

Further, the main-body control section 40 transfers data of the post-processing mode, the number of sheets, information of number-of-copies, sheet thickness information of a sheet for image formation and the like to the post-processing control section 50. Concurrently therewith, the main-body control section 45 transfers a job end signal to the post-processing control section 50 for each finish of image formation.

The post-processing mode will be described. The "print out mode (first sheet discharge mode)" is to store a sheet from the sheet discharge outlet 13 on the stack tray 15 without performing post-processing. In this case, the sheet is directly carried out to the stack tray 15 from the sheet discharge outlet 13 without being collected on the sub-tray 18 (first and second support members 19, 20). The "staple finish mode (staple binding processing mode, second sheet discharge mode)" is to collect sheets from the sheet discharge outlet 13 on the sub-tray 18 to collate, perform the binding processing on a bunch of the sheets, and then store the sheets on the stack tray 15. In this case, in principle, an operator designates sheets with the same paper thickness of the same size as the sheets to undergo image formation.

The "job sort mode (third sheet discharge mode)" is to perform jog sort by a group in which sheets with images formed in the image formation apparatus A are carried out from the sheet discharge outlet 13 to the stack tray 15 on a sheet-by-sheet basis and by collating and collecting sheets from the sheet discharge outlet 13 on the sub-tray 18 (first and second support members 19, 20). At this point, the side edge regulation stopper 25 described previously is disposed in a position in which the sheet side edge is offset by a predetermined amount in aligning the sheets on the sub-tray 18. Then, after collecting the bunch on the sub-tray 18, the support members 19, 20 are retracted to outside the stack tray 15, and the bunch is dropped onto the stack tray 15 to store. By this means, on the paper mount surface 15*a*, sheet groups carried out in the predetermined reference (center reference or side reference) from the sheet discharge outlet 13, and sheet groups which are offset by a predetermined amount and collected on the sub-tray 18 are stored in different positions in the width direction and are sorted for each collated group.

[Post-processing Control Section]

The post-processing control section 50 operates the post-processing apparatus B corresponding to the post-processing mode set in the image formation control section 45. The post-processing control section shown in the figure is comprised of a control CPU 50 (hereinafter, simply referred to as control means). The control CPU 50 is coupled to ROM 51 and RAM 52, and executes sheet discharge operation described later using a control program stored in the ROM 51 and control data stored in the RAM 52.

Therefore, the control CPU 50 transmits command signals to respective driver circuits (see FIG. 18) of the transport motor M1, first shift motor SM1, second shift motor SM2, travel motor M3, paddle motor M4, and pusher motor M5 described previously. Further, the control CPU 50 is connected to sheet sensors Se and position sensors Ps to be able to receive each detection signal. The sheet sensors Se is the carry-in sensor Se1, sheet discharge sensor Se2, and full sensor Se that detects full of sheets on the tray, not shown, and each sensor transmits a respective state signal to the control means 50.

Further, the position sensors Ps are the position sensor Ps1 of the first support member (rear end support member) 19, position sensor Ps2 of the second support member (side end support member) 20, friction transport body position sensor Ps3, position sensor Ps4 of the paddle rotating body (paddle member) 35, and position sensor Ps5 of the pusher means 37, and each sensor transfers a respective state signal to the control means. In addition, for the driver circuit of each driver motor, the control means 50 transmits command signals to each circuit to control motor start, motor halt and speed control by PWM control, encode control or the like.

[Post-processing Operation]

Figure 19:
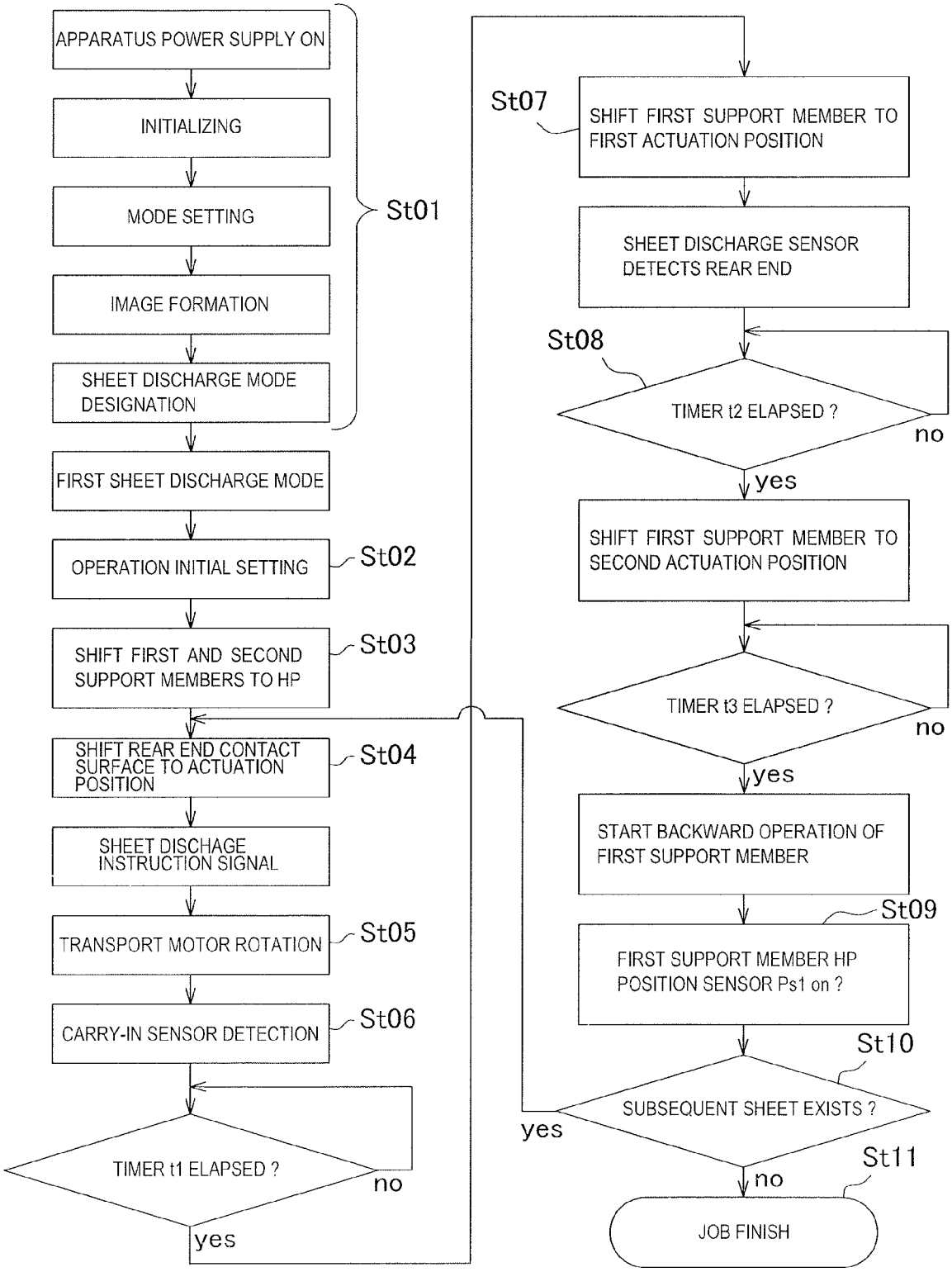
FIG. 19 is an operation explanatory diagram (flowchart) of the first sheet discharge mode of the post-processing apparatus of FIG. 2.
Figure 20A:
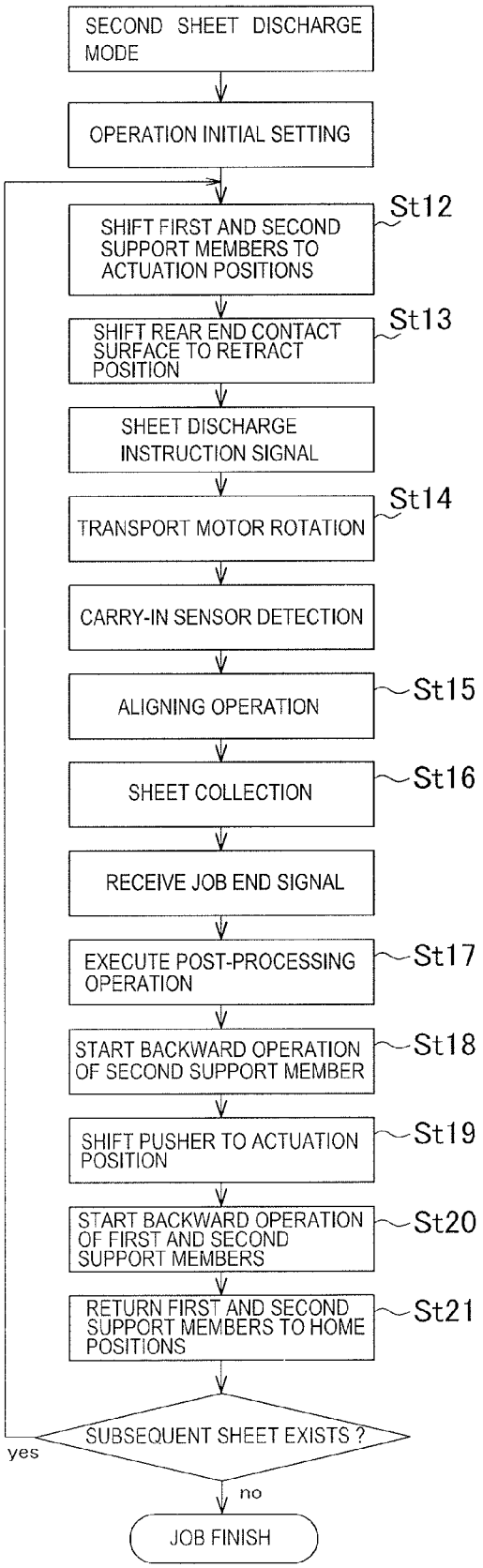
FIG. 20A is a diagram showing an operation flow of a second sheet discharge mode of the post-processing apparatus of FIG. 2.
Figure 20B:
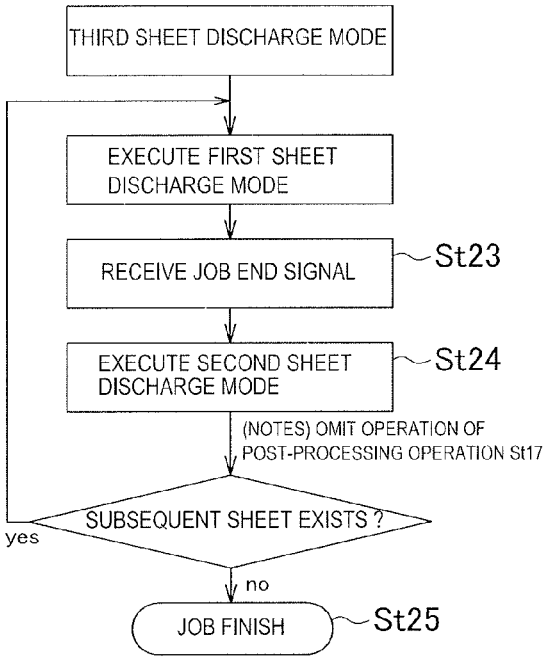
FIG. 20B is a diagram showing an operation flow of the third sheet discharge mode of the post-processing apparatus of FIG. 2.

FIG. 19 shows the case where the first sheet discharge mode (straight sheet discharge operation, printout sheet discharge operation) is set in the mode setting in the image formation apparatus A, FIG. 20A shows case where the second sheet discharge mode (staple binding operation) is set, and FIG. 20B shows the case where the third sheet discharge mode (jog sheet discharge operation) is set.

The sheet discharge control means 50 executes initializing operation in apparatus power supply ON (St01). For example, this initializing operation is to execute the following initial position setting. The means 50 detects whether the first support member (rear end support member) 19 is in the waiting position (retract position, home position) Wp using the position sensor Ps1, and in "No", shifts to the sensor "ON" position. Similarly, the second support member (side edge support member) 20 is shifted to the waiting position (home position) Wp.

Next, the pusher means 37 is shifted to the home position. In the apparatus shown in the figure, the home position is set at the waiting position (retrace position) Wp, and the rear end contact surface (paper press surface) 39*s* is retraced to outside the stack tray 15 (states of FIGS. 5A and 5B). Further, this initializing operation is to set the post-processing means 23 (the means shown in the figure is the staple unit) at the initial state.

[First Sheet Discharge Mode]

Then, the sheet discharge control means 50 receives a mode setting signal from the image formation control section 45. When the first sheet discharge mode is designated with this command signal, the post-processing control means 50 executes the following initial operation (St02).

Further, as the initial operation setting, the sheet discharge control means 50 determines whether or not the first and second support members 19, 20 are positioned in the home positions. When the members are in positions except the home positions, the positions of the members are shifted to the home positions (St03). Concurrently therewith, the sheet discharge control means 50 shifts the rear end contact surface (paper press surface) 39*s* of the slide member (sheet press member) 38 to a regulation position protruding to inside the tray (state of FIG. 3A; St04). This operation shifts the slide member 38 from the home position by a beforehand set shift amount with the pusher motor M5. Then, the rear end contact surface 39*s* is set at the position protruding slightly to the inside of the tray by about 2 mm from the rear end regulation surface 16 of the stack tray 15 (see Dz shown in FIG. 3A).

Upon receiving a job start signal from the image formation control section 45, the post-processing control section 50 rotates the transport motor M1 and rotates the transport rollers 14*a* and sheet discharge rollers 14*b* in the sheet discharge direction (st05). By this means, the sheet carried out to the main-body sheet discharge outlet 6 is carried in the sheet carry-in path 11, and the carry-in sensor Se1 detects the sheet front end. For example, this detection signal is used in determining a sheet jam from a time difference between detection of the sheet front end with this sensor and subsequent detection of the sheet rear end and the sheet size information and the like, and thus is used in control of the subsequent post-processing operation (St06).

The control means 50 starts a timer t1 when the carry-in sensor Se1 detects the sheet front end. This timer t1 time is set at a predicted time such that the sheet front end arrives at a predetermined position from the sheet discharge outlet 13. When this time t1 has elapsed, the control means 50 shifts the first support member (rear end support member) 19 from the waiting position (retract position) Wp to the first actuation position Ap1 (St07). Accordingly, the timer time t1 is set at timing at which the sheet front end shifts from the sheet discharge outlet 13 to the predetermined first actuation position Ap1 and then the sheet engagement surface 19*s* of the support member 19 engages in the sheet lower surface.

When the sheet discharge sensor Se2 detects the sheet rear end, the control means 50 starts a timer t2 (St08). This timer time t2 is set at timing at which the sheet rear end separates from the nip point of the sheet discharge rollers 14*b*. Then, after a lapse of the timer time t2, the control means 50 shifts the first support member 19 from the first actuation position Ap1 to the second actuation position Ap2 (St09). The shift amount Δk is set to be larger than the radius of the sheet discharge roller. Accordingly, after separating from the sheet discharge rollers 14*b*, the sheet rear end is pushed in the sheet direction by the predetermined amount Δk by the first support member 19. As a result, such a rear end remaining phenomenon is not invited that the sheet rear end remains on the sheet discharge roller periphery.

Next, when the sheet discharge sensor Se2 detects the sheet rear end, the control means 50 starts the timer t3 concurrently with the timer t2, and after a lapse of the time, control means 50 shifts the first support member 19 backward to the waiting position. The timer time t3 is set at a time required for the first support member 19 to shift from the first actuation position Ap1 to the second actuation position Ap2, and is set so that the timer time t3 has elapsed after the support member 19 shifted to the second actuation position Ap2 (St09).

Then, the control means 50 detects the state in which the first support member 19 returns to the waiting position Wp with the home position sensor Sp1 (St09). Then, the control means 50 determines whether or not a subsequent sheet exists with the information from the image formation apparatus (St10). When the subsequent sheet exists, the means 50 repeats prior steps St05 to St10. Then, when the subsequent sheet does not exist, the means 50 halts the apparatus as job finish (St11).

[Second Sheet Discharge Mode]

Operation when the second sheet discharge mode is selected as the sheet discharge mode will be described next according to FIG. 20A. Upon receiving a command signal of the second sheet discharge mode from the image formation control section 45, the control means 50 executes the following initial setting operation. The means 50 shifts the first and second support members 19, 20 from the home positions (waiting positions, retract positions) to the actuation positions.

Concurrently therewith, the control means 50 rotates the shift motor SM1 of the first tray shift means 21 and the second shift motor SM2 of the second tray shift means 22 in respective predetermined directions, and shifts the positions of the first and second support members 19, 20 positioned in the home positions to the actuation positions Ap above the paper mount surface 15*a* (St12). Concurrently therewith, the control means 50 shifts the friction transport body 27 to the waiting position. The means 50 positions the travel motor M3 of the friction transport body described previous in the home position to rotate. By this rotation, the friction transport body 27 waits in the retract position retracted to above the first and second support members 19, 20.

Further, the control means 50 shifts the position of the rear end contact surface (paper press surface) 38S provided in the bent piece 38 of the slide member 39 to the waiting position (retract position) Wp retracted to outside the stack tray 15. In this operation, the pusher motor M5 is actuated, and the sensor flag is detected with the position sensor Ps5.

By the initial operation as described above, the first and second support members 19, 20 are positioned between the sheet discharge outlet 13 and the paper mount surface 15*a* while protruding to the inside of the tray, and are prepared in a state enabling the sheet rear end portion fed from the sheet discharge outlet 13 and the sheet side edge portion respectively to be mounted on the first support member (rear end support member) 19 and second support member (side edge support member) 20.

Next, upon receiving a sheet discharge instruction signal from the image formation control section 45, the control means 50 rotates the transport motor M1, and carries in an image-formed sheet from the carry-in entrance 12. This sheet passes through the sheet carry-in path 11, is guided to the sheet discharge outlet 13, and is loaded from the sheet discharge outlet 13 on the first and second support members below.

With reference to a signal such that the sheet discharge sensor Se2 detects the sheet rear end portion, after a lapse of a predetermined time, the control means 50 rotates the travel motor M3 a predetermined angle. By this travel motor, the friction transport body 27 shifts from the waiting position retracted to above the sheet top surface to the actuation position to engage in the top surface of the sheet, and drags and transports the sheet in the travel direction inclined a predetermined angle with respect to the sheet discharge direction (St15). At this point, the sheet rear end is struck by the rear end regulation stopper 24, the sheet side edge is struck by the side edge regulation stopper 25, and the sheet is positioned (St15).

By subsequent rotation of the travel motor M3, the friction transport body 27 returns to the waiting position (retract position) spaced above the sheet, and the motor is halted. By repeating the operation of steps St14 and St15 as described above, sheets continuously fed from the sheet discharge outlet 13 are collected on the first and second support members 19, 20 and collated (St16). In addition, in the case of no subsequent sheet, the aligning transport means 26 (friction transport body 27) does not shift to the home position, and halts in the sheet strike position in FIG. 8B. Next, upon receiving a job end signal from the image formation control section 45, the control means 50 issues a post-processing operation instruction (command) signal. Upon receiving this command signal, the post-processing unit 23 executes the post-processing operation (St17), and after finish of the operation, transmits a processing end signal to the control means 50.

Then, the control means 50 starts backward operation of the second support member 20 (St18), and support of a bunch of sheets by the second support member 20 is released. Subsequently, the means 50 starts the pusher motor M5, and shifts the rear end contact surface (paper press surface) 39*s* of the bent piece 39 of the slide member (sheet press member) 38 from the waiting position (retract position) to the predetermined position inside the stack tray 15. Then, the rear end of the bunch of sheets supported by the first support member (rear end support member) 19 is pushed to the predetermined position above the paper mount surface 15*a* (St19). Subsequently, the means 50 starts backward operation of the first support member 19 (St20). In addition, operation start timing of backward of the second support member 20, proceeding of the slide member 38 and backward of the first support member 19 is not limited to shifting to next operation after completing each operation, and it is essential only that the first support member 19 supports the rear end of the bunch of sheets at least at the time support of the bunch of sheets by the second support member 20 is released. Then, after the first and second support members 19, 20 return to the home positions (St21), the control means 50 determines whether or not a subsequent sheet exists, and when the subsequent sheet exists, returns to step S12 to repeat operation of the same prior steps St12 to St21. Meanwhile, when the subsequent sheet does not exist, the means 50 halts the operation as job finish.

[Third Sheet Discharge Mode]

Operation when the third sheet discharge mode is selected as the sheet discharge mode will be described according to FIG. 20B. When the third sheet discharge mode is selected, the control means 50 stores sheets fed from the sheet discharge outlet 13 on the stack tray 15 by the same operation as in the first sheet discharge mode (St23). Then, the control means receiving a job end signal executes the sheet discharge operation of the second sheet discharge mode (St24).

Upon receiving a job end signal next, the control means 50 executes the first sheet discharge mode, and repeats the mode sequentially. By such operation, in the first sheet discharge mode, sheets are collected on the stack tray 15 in the sheet discharge reference (center reference of side reference) from the sheet discharge outlet 13. In the next second sheet discharge mode, sheets are collected on the stack tray 15 with the sheet discharge position being offset by a predetermined amount. By such operation, sheets are jog-sorted and stored for each number of copies on the stack tray (St25).

Supplements A1 to A11, etc. are added to the above-mentioned Embodiments.

(Supplement A1)

A sheet discharge apparatus characterized by being provided with a sheet discharge path having a sheet discharge outlet, a stack tray disposed below with a height difference formed from the sheet discharge outlet, a sub-tray disposed between the sheet discharge outlet and the stack tray to temporarily hold a sheet fed from the sheet discharge outlet, and a sheet alignment mechanism that positions the sheet fed to the sub-tray in a predetermined regulation position, where the sheet alignment mechanism is comprised of sheet rear end regulation means for striking at least one end edge of the sheet supported on the sub-tray to regulate, sheet carry means for carrying the sheet fed onto the sub-tray from the sheet discharge outlet to the sheet end regulation means, and sheet guide means disposed above the sub-tray to guide the sheet carried by the sheet carry means toward the sheet end regulation means, the sheet end regulation means is comprised of a plurality of stopper members engaging in one end edge of the sheet with a distance formed from each other, the sheet carry means is comprised of a friction transport member that reciprocates by a predetermined stroke to carry the sheet carried onto the sub-tray toward the stopper members, the sheet guide means is comprised of first guide members that regulate curved deformation of the sheet moving toward the stopper member, and a second guide member that guides a sheet curled upward to the first guide members, at least a pair of the first guide members are spaced a distance apart in a direction substantially orthogonal to the sheet end edge locked by the plurality of stopper members, and the second guide member is disposed between the pair of the first guide members in the direction crossing the sheet end edge locked by the stopper members.

(Supplement A2)

The sheet discharge apparatus as described in supplement A1, characterized in that each of the first guide members has a guide surface inclined so as to lower from the center portion to the stopper member side of the sub-tray, and that the second guide member has a guide surface to regulate the height position of the sheet on the sub-tray.

(Supplement A3)

The sheet discharge apparatus as described in supplement A1 or A2, characterized in that the second guide member is disposed in a travel guide member that guides reciprocating of the friction transport member.

(Supplement A4)

The sheet discharge apparatus as described in any one of supplements A1 to A3, characterized in that the sheet end regulation means is comprised of a side end edge stopper member that locks one side end edge of the sheet carried onto the sub-tray, and a rear end edge stopper member that locks the rear end edge of the sheet, and that the travel guide member of the friction transport member is disposed in the same side end portion as the side end edge stopper member with respect to the sheet carried onto the sub-tray.

(Supplement A5)

The sheet discharge apparatus as described in supplement A1, characterized in that the sheet transport path is configured to carry out sheets of different sizes in the center reference from the sheet discharge outlet, the sheet carry means is set for a sheet transport direction so that lock protrusions first strike the sheet side end edge and then strike the sheet rear end edge, and that the sheet transport direction is set with reference to a minimum-size sheet.

(Supplement A6)

The sheet discharge apparatus as described in supplement A1, characterized in that the rear end edge stopper and the side end edge stopper are formed of a plurality of protrusion members spaced a distance apart from one another, and that on the sub-tray, post-processing means is disposed between adjacent protrusion members with the sheet corner therebetween among the plurality of protrusion members.

(Supplement A7)

The sheet discharge apparatus as described in supplement A6, characterized in that the rear end edge stopper member is formed of a pair of left and right protrusion members spaced a distance apart in the sheet-discharge orthogonal direction, the side end edge stopper member is formed of a pair of front and back protrusion members spaced a distance apart in the sheet discharge direction, the distance of the rear end edge stopper member is set to be shorter than a length in the transport orthogonal direction of the minimum size in a posture of the sheet carried onto the sub-tray from the sheet transport path, and that the distance of the side end edge stopper member is set to be shorter than a length in the transport direction of the minimum size in a posture of the sheet carried onto the sub-tray from the sheet transport path.

(Supplement A8)

The sheet discharge apparatus as described in supplement A6 or A7, characterized in that each of the rear end edge stopper member and the side end edge stopper member is comprised of rollers among which at least one is rotatable, and that the roller is provided with a rotation force for shifting the sheet end edge toward the regulation position.

(Supplement A9)

The sheet discharge apparatus as described in any one of supplements A1 to A8, characterized in that the sheet carry means is comprised of a friction transport member to engage in a top surface of the sheet carried onto the sub-tray, and travel guide means for shifting the friction member by a predetermined distance with the member engaging in the sheet.

(Supplement A10)

The sheet discharge apparatus as described in supplement A9, characterized in that the friction transport member is comprised of a floating roller, and that the travel means is comprised of a link member that develops inch worm motion in the floating roller.

(Supplement A11)

An image formation system characterized by being comprised of an image formation apparatus that forms an image on a sheet, and a sheet discharge apparatus that mounts and stores sheets fed from the image formation apparatus, where the sheet discharge apparatus is the sheet discharge apparatus as described in any one of supplements A1 to A10.

The background art, object and the others on the invention concerning supplements A1 to A11 will be described next. The invention concerning supplements A1 to A11 relates to the sheet discharge apparatus which temporarily collects image-formed sheets to perform post-processing and then stores on the stack tray on the downstream side, and relates to improvements in the sheet alignment mechanism for aligning a sheet surface in the post-processing position.

Generally, this kind of sheet discharge apparatus is widely used as an apparatus which temporarily holds sheets carried out of a sheet discharge path on a processing tray to perform post-processing such as staple binding, punching and stamping and then stores on a stack tray on the downstream side.

For example, in Patent Document 2 (Japanese Patent Gazette No. 4901082), a sheet support member is disposed between a path sheet discharge outlet and a tray paper mount surface, and sheets fed from a sheet discharge path to a stack tray are collated and collected on the support member to perform binding processing on the sheet corner portion. Then, disclosed is a sheet discharge mechanism for storing the binding-processed bunch of sheets on the stack tray.

In such an apparatus, it is necessary to correctly position sheets carried out of the sheet discharge outlet in a processing position of the support member to perform post-processing. In the apparatus of Patent Document 2 is disclosed an alignment mechanism in which sheet carry means is disposed on the support member, and carries sheets toward stoppers to lock the sheet rear end portion and sheet side end portion.

Such an apparatus is already known that a sub-tray is disposed between a sheet discharge outlet and a stack tray to temporarily hold sheets, and that post-processing is performed on a bunch of collected sheets on the tray. Such an apparatus requires either the structure in which a post-processing apparatus (unit) moves forward and backward from outside the tray to above the tray with respect to sheets collected on the sub-tray as in Patent Document 2 or the structure for offset-transporting the sheets carried onto the sub-tray to a processing position outside the tray.

The conventionally known structure of Patent Document 2 requires a guide mechanism and drive mechanism that shift the staple unit for performing binding processing on a bunch of sheets from outside the tray to inside the tray, and in consideration of impact in staple operation, it is necessary to support the guide mechanism with robustness without rattling. Therefore, the problems are known that the apparatus is large and heavy, and the like.

Then, in adopting the structure for offset-transporting sheets carried onto the sub-tray to the post-processing position outside the tray, a curled sheet or weak sheet may be collected in an uneven state of not reaching the regulation stopper, and further, there is the problem that a strong sheet rebounds after striking the regulation stopper and is uneven.

As well as such uneven sheet alignment, in the relation in the arrangement of the regulation stopper and the sheet carry means for carrying sheets toward the regulation stopper on the periphery of the sub-tray, for example, in carrying a curled and warped sheet on the sub-tray to the stopper by the sheet carry means, such a problem occurs that the sheet is caught on the carry mechanism and jams.

It is an object of the invention concerning supplements A1 to A11 to provide a sheet discharge apparatus that enables sheets fed from a sheet discharge outlet to be aligned neatly in a processing position and subjected to post-processing. Further, it is another object of the invention concerning supplements A1 to A11 to provide a sheet guide mechanism with few sheet jam and little positional displacement in transporting sheets carried onto a processing tray from a sheet discharge outlet to a processing position outside the tray to position.

In the invention concerning supplements A1 to A11, the apparatus is provided with a sub-tray that temporarily holds sheets fed from a sheet discharge outlet, sheet carry means for carrying the sheets carried onto the sub-tray toward a stopper member disposed outside the tray, and first and second guide members that guide the sheets from the sheet carrying-out position on the sub-tray to the stopper position. It is a feature that at least a part of first guide members are spaced a distance apart in the direction substantially orthogonal to the sheet end edge to engage in the stopper member, and that the second guide member is disposed in the direction crossing the sheet end between the first guide members.

Further, the configuration will be described specifically. The apparatus is provided with a sheet discharge path (11) having a sheet discharge outlet (13), a stack tray (15) disposed below with a height difference formed from the sheet discharge outlet, a sub-tray (18) disposed between the sheet discharge outlet and the stack tray to temporarily hold a sheet fed from the sheet discharge outlet, and a sheet alignment mechanism that positions the sheet fed to the sub-tray in a predetermined regulation position.

The sheet alignment mechanism is comprised of sheet rear end regulation means (24, 25) for striking at least one end edge of the sheet supported on the sub-tray to regulate, sheet carry means (28) for carrying the sheet fed onto the sub-tray from the sheet discharge outlet to the sheet end regulation means, and sheet guide means disposed above the sub-tray to guide the sheet carried by the sheet carry means toward the sheet end regulation means.

The sheet end regulation means is comprised of a plurality of stopper members engaging in one end edge of the sheet with a distance formed from each other, the sheet carry means is comprised of a friction transport member (27) that reciprocates by a predetermined stroke to carry the sheet carried onto the sub-tray toward the stopper members, and the sheet guide means is comprised of first guide members that regulate curved deformation of the sheet moving toward the stopper member, and a second guide member that guides a sheet curled upward to the first guide members.

At this point, at least a pair of the first guide members are spaced a distance apart in a direction substantially orthogonal to the sheet end edge locked by the plurality of stopper members, and the second guide member is disposed between the pair of the first guide members in the direction crossing the sheet end locked by the stopper members.

In the invention concerning supplements A1 to A11, the sub-tray is disposed between the sheet discharge outlet and the stack tray to be able to proceed and retract between inside and outside the tray paper mount surface, outside the paper mount surface of the sub-tray are provided the sheet rear end regulation means for regulating the sheet end edge, the sheet carry means for carrying the sheet toward the regulation means, and the sheet guide means for guiding the carried sheet toward the regulation means, the sheet guide means is comprised of the first guide members that prevent the sheet from being curved and deformed, and the second guide member that guides the sheet curved upward to the first guide members, the second guide member is disposed between a pair of the first guide members spaced a distance apart in the crossing direction, and therefore, the invention exhibits the following effects.

The invention concerning supplements A1 to A11 is to carry sheets carried onto the sub-tray from the sheet discharge outlet to a processing position positioned outside the paper mount tray of the stack tray by the sheet carry means to perform post-processing, eliminates the need for installing the post-processing unit in the apparatus frame to be movable, and is capable of configuring the sheet discharge apparatus provided with the post-processing function in compact size with a simplified structure.

Further, in the invention concerning supplements A1 to A11, it is configured that sheets carried onto the sub-tray are reliably struck and aligned in the regulation stopper in the post-processing position by the first guide members without rebounding, and that a warped curl sheet on the tray is guided to the first guide members by the second guide member, and it is thereby possible to reliably guide even a weak sheet to the stopper member.

Furthermore, the second guide member is disposed in the travel guide member of the sheet carry means for carrying the sheet to the regulation stopper, and it is thereby possibly to attach the guide member with a simplified structure at low cost.

Supplements B1 to B8, etc. are added to the above-mentioned Embodiments.

(Supplement B1)

A sheet post-processing apparatus characterized by being provided with a sheet discharge path having a sheet discharge outlet, a stack tray having a paper mount surface spaced a height difference apart from the sheet discharge outlet, a sub-tray disposed between the sheet discharge outlet and the paper mount surface to temporarily support sheets fed from the sheet discharge outlet, tray shift means for causing the sub-tray to reciprocate between an actuation position positioned inside the paper mount surface and a waiting position positioned outside the paper mount surface, sheet carry means for shifting the sheets on the sub-tray backward in the direction opposite to the sheet discharge direction of the sheet discharge path, and a regulation stopper that positions the sheets fed by the sheet carry means in a predetermined post-processing position, where the regulation stopper is comprised of a plurality of side end stopper members having a lock distance to strike and regulate a side end portion of the sheets, and a plurality of rear end stopper members having a lock distance to strike and regulate a rear end portion of the sheets, the sheet carry means is comprised of a friction travel member that travels along a predetermined trajectory to transport the sheets carried onto the sub-tray toward the post-processing position, and the travel trajectory of the friction travel member is to travel along a track for first coming into contact with beforehand set one of the stopper members and then coming into contact with the other stopper members in a direction for moving the sheets carried onto the sub-tray to the lock distance of one of the side end stopper members and the rear end stopper members toward the post-processing position.

(Supplement B2)

The sheet post-processing apparatus as described in supplement B1, characterized in that the sheet discharge path is configured to carry out sheets of different sizes from the sheet discharge outlet in the center reference, and that the shift trajectory of the friction travel member is set with reference to a minimum-size sheet carried onto the sub-tray.

(Supplement B3)

The sheet post-processing apparatus as described in supplement B1 or B2, characterized in that the friction travel member is comprised of a floating roller that engages in carried-out sheets on the sub-tray, an arm member that supports the floating roller while shifting along the shift trajectory, and a drive motor that drives the arm member.

(Supplement B4)

The sheet post-processing apparatus as described in supplement B3, characterized in that after the end edge of the sheets comes into contact with the one of the stopper members, the floating roller brings the sheet end edge into contact with the other stopper members while performing rolling motion following the shift of the sheets.

(Supplement B5)

The sheet post-processing apparatus as described in any one of supplement B1 to B4, characterized in that the side end or rear end stopper members with which the sheets on the sub-tray first come into contact by the action of the friction travel member are comprised of rolling rollers that rotate in a shift direction of the sheets.

(Supplement B6)

The sheet post-processing apparatus as described in supplement B5, characterized in that the rolling rollers disposed in the stopper members are provided with drive means for rotating in a direction for shifting the sheet end edge toward the post-processing position.

(Supplement B7)

The sheet post-processing apparatus as described in any one of supplements B1 to B4, characterized in that each of the pluralities of side end stopper members and rear end stopper members is comprised of rolling rollers, and that the rolling rollers are provided with drive means for rotating in a direction for shifting the engaged sheet end edge toward the post-processing position.

(Supplement B8)

An image formation system characterized by being comprised of an image formation apparatus that forms an image on a sheet, and a sheet post-processing apparatus which collects sheets fed from the image formation apparatus to perform binding processing, where the sheet post-processing apparatus is the sheet post-processing apparatus as described in any one of supplements B1 to B7.

The background art, object and the others on the invention concerning supplements B1 to B8 will be described next. The invention concerning supplements B1 to B8 relates to the sheet post-processing apparatus which collates and collects image-formed sheets to perform binding processing, and relates to improvements in the alignment mechanism for positioning sheets carried out of the sheet discharge outlet in a post-processing position accurately.

Generally, this type of sheet post-processing apparatus is widely known as a post-processing apparatus which stacks sheets fed from a sheet discharge outlet of a sheet discharge path in a stacked shape to perform binding processing with a staple apparatus, and stores the processed bunch of sheet on a stack tray.

For example, in Patent Document 2 (Japanese Patent Gazette No. 4901082) is proposed the apparatus in which the support member that holds temporarily sheets is provided between the sheet discharge outlet and the tray paper mount surface in discharging sheets fed from the sheet discharge path to the stack tray, sheets are collected on the support member, and undergo staple binding, and after processing the bunch of sheets, the support member is retracted to outside the tray to store on the paper mount surface.

The apparatus of Document 2 discloses the mechanism in which the sheet support member that comes into and off the inside from the outside of the tray is provided between the sheet discharge outlet of the sheet discharge path and the paper mount surface of the stack tray, and sheets fed from the sheet discharge outlet are collated and collected on the support member, and undergo the binding processing with a staple apparatus disposed at the sheet corner. Then, in order to align the sheets on the support member, the apparatus is provided with the structure in which a transport member (belt in the Document) that transports sheets is lowered downward from above the support member to engage in the discharged sheets, concurrently with entering the inside of the tray from the outside of the tray.

Further, Patent Document 3 (Japanese Patent Gazette No. 3408122) discloses a mechanism disposed at the tray corner to align sheets carried onto a tray (sort bin in the Document) from a sheet discharge outlet in a binding position. In the Document, a lever member (alignment rod 103 in the Document) presses the sheet end edge on the side opposite to the alignment end edge of the sheets carried onto the tray to align in a stopper position.

As described above, such an apparatus is already known that the corner portion of sheets carried out of the sheet discharge outlet is aligned in a predetermined binding position to perform the binding processing, and that the sheets are then dropped onto the stack tray to store. In such an apparatus, in order to perform the binding processing on sheets in a correct posture, it is necessary to support the enter sheets on the plane and to position the sheets in a regulation stopper accurately.

However, in the apparatus configuration in which the support member coming into/off the stack tray aligns sheets in a binding position as the apparatus proposed in Patent Document 2 as described previously, it is not possible to cause a member that supports the entire sheet to come into the inside from the outside of the tray in terms of both space and mechanism. Accordingly, it is required to position sheets in a correct position in a correct posture with a support member that supports a part of the sheet from the sheet discharge outlet.

It is an object of the invention concerning supplements B1 to B8 to provide a sheet post-processing apparatus that enables sheets carried out of a sheet discharge outlet to be positioned in a predetermined processing position accurately. Further, it is another object of the invention concerning supplements B1 to B8 to configure an apparatus, which collects sheets fed from a sheet discharge path to a stack tray in the intermediate position to perform binding processing, in small and compact size with a simplified structure.

In the invention concerning supplements B1 to B8, a sub-tray that temporarily holds sheets is disposed between a sheet discharge apparatus and a paper mount surface of a stack tray to be able to proceed and retract, and disposed are a regulation stopper that positions the sheets carried onto the sub-tray in a post-processing position and sheet carry means for rear-end-carrying the sheets. Then, it is a feature that the regulation stopper is comprised of a plurality of rear end stopper members that lock the sheet rear end by a lock distance and a plurality of side end stopper members that lock the sheet side end by a lock distance, the sheet carry means is comprised of a travel friction member that travels along a predetermined trajectory to transport the sheets toward the post-processing position, and that the travel trajectory is configured so that the sheet end comes into contact with either one of the stopper members within the lock distance of the regulation stopper, and then comes into contact with the other stopper member.

Further, the configuration will be described specifically. The apparatus is provided with a sheet discharge path having a sheet discharge outlet, a stack tray having a paper mount surface spaced a height difference apart from the sheet discharge outlet, a sub-tray disposed between the sheet discharge outlet and the paper mount surface to temporarily support sheets fed from the sheet discharge outlet, tray shift means for causing the sub-tray to reciprocate between an actuation position positioned inside the paper mount surface and a waiting position positioned outside the paper mount surface, sheet carry means for shifting the sheets on the sub-tray backward in the direction opposite to the sheet discharge direction of the sheet discharge path, and a regulation stopper that positions the sheets in a predetermined post-processing position.

The regulation stopper is comprised of a plurality of side edge stopper members having a lock distance to strike and regulate a side end portion of the sheets, and a plurality of rear end stopper members having a lock distance to strike and regulate a rear end portion of the sheets, and the sheet carry means is comprised of a travel friction member that travels along a predetermined trajectory to transport the sheets carried onto the sub-tray toward the post-processing position. The travel trajectory of the friction travel member at this point is set at a trajectory so that the sheets carried onto the sub-tray are placed within the lock distance of one of the side end stopper members and rear end stopper members, come into contact with one of the side end stopper members and rear end stopper members, then come into contact with the other members, and are guided to the post-processing position.

In aligning sheets on the sub-tray disposed between the sheet discharge outlet and the stack tray in a processing position with the travel friction member that travels along a predetermined trajectory, the invention concerning supplements B1 to B8 sets the travel trajectory for a track to come into contact with one of the sheet side end or rear end within a plurality of stopper members having a distance, and then come into contact with the other members, and therefore, exhibits the following effects.

The sheets placed on the sub-tray are positioned at the sheet rear end and sheet side end with a plurality of stopper members having respective predetermined distances. At this point, the sheets are transported by the travel friction member that travels along the travel trajectory formed between stopper members of one of the rear end portion and the side end portion, and the trajectory is formed in a track so that the sheet end strikes one of the rear end and side end stopper members, and then, strikes the other stopper members. Therefore, in the sheets discharged onto the sub-tray, the corner neither enters into the stopper distance nor causes a jam. In other words, the sheets strike one of the rear end and side end, and strike the other stopper in this engaged state, and therefore, there is no fear that the sheer corner enters into the stopper distance.

Further, in the invention concerning supplements B1 to B8, by configuring the beforehand set stopper members at which the sheet end portion is first stopped using floating rollers, and adopting the configuration for driving and rotating the rollers to shift the sheet end in the direction of the post-processing position, it is possible to position in a correct posture without inviting sheet rising deformation or folding deformation.

What is claimed is:

1. A sheet storage apparatus comprising:

a sheet discharge path having a sheet discharge outlet;

a stack tray disposed on a downstream side of the sheet discharge outlet;

a support device disposed between the sheet discharge outlet and the stack tray to load at least a part of a sheet;

a sheet end regulation device for regulating a position of at least one end edge of the sheet supported by the support device; and an aligning transport device disposed in the support device to carry the sheet toward the sheet end regulation device, wherein the aligning transport device is comprised of a friction transport body that engages in a top surface of the sheet supported by the support device, and a transport body travel device for shifting the friction transport body along a sheet surface by a predetermined amount in a travel direction crossing a sheet discharge direction at a predetermined angle, and the friction transport body has a rotating member rolling along the top surface of the sheet supported by the support device, and the rotating member rotates in a direction crossing the travel direction.

2. The sheet storage apparatus according to claim 1, wherein the sheet end regulation device is comprised of a first regulation member that regulates a position of a front end edge or a rear end edge in the sheet discharge direction of the sheet fed from the sheet discharge outlet, and a second regulation member that regulates a position of a side end edge in a sheet-discharge orthogonal direction of the sheet, and the aligning transport device is set such that the travel direction of the friction transport body is an angle direction to provide the sheet fed from the sheet discharge outlet with a transfer force for moving to the first regulation member and a transport force for moving to the second regulation member.

3. The sheet storage apparatus according to claim 1, wherein the aligning transport device is formed such that a sheet end edge first engages in one of the first and second regulation members, and that the other sheet end edge then engages in the other regulation member, and the rotating member rotates in a direction for bringing the sheet end edge closer to the other regulation member after the sheet end edge engages in the one of the regulation members.

4. The sheet storage apparatus according to claim 1, wherein the rotating member is a roll member that has a rotating shaft in the travel direction and rotates in the travel orthogonal direction on the rotating shaft.

5. The sheet storage apparatus according to claim 1, wherein the rotating member is comprised of a sphere body rotating in multiple directions along the sheet surface on the support device, and the sphere body is provided with a brake device for suppressing rotating motion in the travel direction.

6. The sheet storage apparatus according to claim 1, further comprising a post-processing device for binding sheets collected in a shape of a bunch, and a bunch carrying-out device for carrying out a bunch of sheets subjected to binding processing to the stack tray on the downstream side, each being disposed in the support device.

7. The sheet storage apparatus according to claim 1, further comprising a jog device for offsetting sheets fed from the sheet discharge outlet to store on a paper mount surface of the stack tray, disposed in the support device.

8. The sheet storage apparatus according to claim 1, wherein the transport body travel device constituting the aligning device is comprised of a first arm member axially rotatably supported by an apparatus frame, a second arm member axially rotatably supported by the first arm member, an actuation arm member axially supported by the second arm member, and a travel motor coupled to the second arm member, and the friction transport body is held by the actuation arm member.

9. The sheet storage apparatus according to claim 8, wherein the travel motor and the second arm member are arranged such that the friction transport body held by the actuation member performs inch worm motion.

10. The sheet storage apparatus according to claim 1, wherein the support device is comprised of a rear end support member that supports a rear end of the sheet fed from the sheet discharge outlet, and a side edge support member that supports a side edge of the sheet.

11. The sheet storage apparatus according to claim 10, wherein the rear end support member shifts positions in front and back in the sheet discharge direction of the sheet carried out from the sheet discharge outlet, and shifts between an actuation position positioned above a paper mount surface of the stack tray and a waiting position retracted therefrom.

12. The sheet storage apparatus according to claim 10, wherein the side edge support member shifts positions in a sheet-discharge orthogonal direction of the sheet carried out from the sheet discharge outlet, and shifts between an actuation position positioned above a paper mount surface of the stack tray and a waiting position retracted therefrom.

13. An image formation system comprising:

an image formation apparatus that forms an image on a sheet sequentially; and the sheet storage apparatus according to claim 1, the sheet storage apparatus storing the sheet fed from the image formation apparatus.

14. The sheet storage apparatus according to claim 1, wherein the friction transport body freely rotates in a direction different from the sheet discharge direction.

15. The sheet storage apparatus according to claim 14, wherein the sheet end regulation device includes a first regulation member regulating a position of one end edge in the sheet discharge direction of the sheet fed from the sheet discharge outlet, and a second regulation member regulating a position of a side end edge in a sheet-discharge orthogonal direction of the sheet, and the first regulation member rotates in a direction shifting the sheet toward the second regulation member when the first regulation member engages the one end edge of the sheet, and the second regulation member rotates in a direction shifting the sheet toward the first regulation member when the second regulation member engages the side end edge of the sheet.

16. The sheet storage apparatus according to claim 15, wherein each of the first regulation member and the second regulation member includes lock protrusions apart from each other and a belt interlocking the lock protrusions to rotate along with rotations of the lock protrusions, and each of the belts shifts the sheet in cooperation with the aligning transport device.

* * * * *